US010724289B2

(12) United States Patent
Mayo et al.

(10) Patent No.: US 10,724,289 B2
(45) Date of Patent: Jul. 28, 2020

(54) EXTENDABLE EXTRUDED DOOR FRAME

(71) Applicant: Dorr Houzzer USA LLC, Pompano Beach, FL (US)

(72) Inventors: Richard Mayo, Lake Worth, FL (US); Réne Cliche, Pembrooke Park, FL (US)

(73) Assignee: Dorr Houzzer USA LLC., Pompano Beach, FL (US)

( * ) Notice: Subject to any disclaimer, the term of this patent is extended or adjusted under 35 U.S.C. 154(b) by 69 days.

(21) Appl. No.: 15/806,541

(22) Filed: Nov. 8, 2017

(65) Prior Publication Data

US 2018/0283083 A1 Oct. 4, 2018

Related U.S. Application Data

(60) Provisional application No. 62/478,656, filed on Mar. 30, 2017.

(51) Int. Cl.

| | |
|---|---|
| ***E06B 1/16*** | (2006.01) |
| ***E06B 1/52*** | (2006.01) |
| ***E06B 3/16*** | (2006.01) |
| ***E06B 3/82*** | (2006.01) |

(52) U.S. Cl.

CPC ..... *E06B 1/16* (2013.01); *E06B 1/52* (2013.01); *E06B 3/16* (2013.01); *E06B 3/82* (2013.01)

(58) Field of Classification Search

CPC ..... E06B 1/16; E06B 1/52; E06B 3/16; E06B 3/82; E06B 1/10; E06B 1/20; E06B 1/30; E06B 1/6061

See application file for complete search history.

(56) References Cited

U.S. PATENT DOCUMENTS

| | | | | | |
|---|---|---|---|---|---|
| 2,826,282 | A * | 3/1958 | Goldberg | E06B 1/20 | 49/436 |
| 3,545,135 | A * | 12/1970 | Lieber | E06B 1/30 | 49/505 |
| 4,040,219 | A * | 8/1977 | Budich | E06B 3/22 | 52/209 |
| 4,589,229 | A * | 5/1986 | Warren | E06B 1/10 | 49/382 |
| 4,787,184 | A * | 11/1988 | Boidron | E06B 1/30 | 52/208 |
| 4,878,325 | A * | 11/1989 | Van Tuyl | E06B 1/20 | 52/217 |
| 4,986,034 | A * | 1/1991 | Mozuras | E06B 1/20 | 49/505 |
| 5,168,669 | A * | 12/1992 | Knapp | E06B 7/2316 | 49/470 |

(Continued)

*Primary Examiner* — Brian D Mattei
(74) *Attorney, Agent, or Firm* — Polsinelli PC

(57) ABSTRACT

A door frame component is provided. The door frame includes: a front wall, a rear wall, an outer wall and an inner wall; a length of the front wall being substantially the same as a distance between the inner wall and the outer wall; an internal cavity at least partially defined by space between the inner wall and outer wall; and opposing first and second gripping sections defined in the internal cavity at least partially by first and second internal flanges in the internal cavity. The frame has sufficient structural integrity such that when the frame is cut height wise between the first and second internal flanges into front and rear sections, the front section can support a door on its own without the rear section.

14 Claims, 31 Drawing Sheets

(56) References Cited

U.S. PATENT DOCUMENTS

| | | | | | |
|---|---|---|---|---|---|
| 5,187,898 | A * | 2/1993 | McKann | E06B 1/20 | 49/505 |
| 5,203,130 | A * | 4/1993 | Freelove | E06B 1/30 | 52/211 |
| 5,293,723 | A * | 3/1994 | Slessor | E06B 1/30 | 49/380 |
| 5,528,869 | A * | 6/1996 | Boomer | E06B 1/30 | 49/505 |
| 9,080,373 | B2 * | 7/2015 | Silk | E06B 1/20 | |
| 2007/0022699 | A1 * | 2/2007 | Wang | E06B 1/30 | 52/656.4 |
| 2008/0172956 | A1 * | 7/2008 | Boldt | E06B 1/30 | 52/204.1 |
| 2017/0114587 | A1 * | 4/2017 | Rochon | E06B 1/52 | |

* cited by examiner 1204
1202

300
TYP. WALL THICKNESS .075
BREAK SHARP CORNERS .015R.

EXTENDABLE EXTRUDED DOOR FRAME

CROSS REFERENCE TO RELATED APPLICATIONS

The instant application claims priority to U.S. 62/478,656, entitled Extendable Extruded Door Frame, filed on Mar. 30, 2017, the contents of which are incorporated herein by reference in their entirety.

FIELD OF THE INVENTION

The various embodiments described herein relate generally to a concealed extruded door frame. More particularly, various embodiments herein relate to door frames made of extruded material that establishes a seamless and uniform appearance.

BACKGROUND

Typical door and wall construction methodologies rely upon drywall mounted over a wall frame (such as wood, metal or concrete). Sheets of drywall are joined by drywall joining compound (referred to herein as "mud") and/or drywall tape to form the walls and painted over to provide an overall uniform aesthetic. Corners at the end of walls are formed in the same way, although corners formed by mud and tape are rounded and uneven.

Doors are formed in walls by creating a cavity in the wall frame with studs, lining the studs with frame components, and mounting the door in the frame. A casing which protrudes beyond the wall is typically mounted on top of the frame. The door itself is typically flush with the casing on one side or the other, but this is not always the case. Due to the protrusion of the casing and door, the design has an uneven visual aesthetic.

Some home décor styles, such as modern, are based on clean, sharp lines. Metal door frames are popular in this space, as the metallic color fits the visual style, and the near perfection in the dimensions provides for sharp corners and a uniform visual appearance. Various door frame designs can also be made flush with the wall, such that the wall, frame and door appear as a commonly extending surface.

Referring now to FIG. 1, metal door frames can be made from extruded aluminum frame components 102 in batch heights (e.g., 10 feet long), and cut to desired height (on site or in advance for typical sized door openings) to form the left, right and top frame section 104/106/108 of the frame 100. Slots in the interior of the frame define corner keys receiving L-shaped corner keys 110 that connect the three sides. The sides are screwed to the adjacent wall frame and/or drywall 112. Hinges and a latch are mounted in the frame, and door 114 is mounted on the hinges. Different frame shapes may be used for the door to open inward or outward.

The frame components 102 have a particular shape per its design in function. FIG. 2A shows a cross section of a prior art door frame component 200 as shown in U.S. Patent Publication 2017/0114587, in particular a cross section of left frame section 104 of frame component 102 taken along line II-II in FIG. 1, where the left side of the door 114 is considered the front and the right side is considered the rear, but this is for purposes of explanation only. FIG. 2B shows a similar prior art frame component 250 for an inwardly opening door taken from the same position and cross section.

Referring to FIG. 2A, an outward frame side 202 of left frame section 104 has outwardly extending flange 216 that is sandwiched between the drywall 112 and the wall studs 218; shims (not shown) may be provided as needed for proper installation. Screws 220 inserted through flange 216 connect the frame side 104 of left frame section 100 to the wall stud 218, and screws 222 inserted through the drywall 112, flange 216 and wall stud 218 secure the front of frame side 104 to the drywall 112. Mud and tape applied (not shown) between the edge of frame side 104 and wall 112 complete the installation to provide a front facing uniform appearance without curves.

A rear side 204 of left frame section 104 has a curved recess 206 configured to engage with a mating plate 208 with a curved edge. To mount and secure the rear side 204 of left frame section to the wall, a lip of mating plate 208 is slid height wise into recess 206 and rotated into a position perpendicular with the rear side of the wall stud 218. Screws as inserted through the plate 208 into the wall stud 218, and additional screws are inserted through the rear drywall 212 (212 not noted on FIG. 2A), plate 208 and wall stud 218. Mud and tape applied will provide a uniform rear facing appearance without curves.

The above prior art frame components have several disadvantages. One drawback is the interlocking nature of the plate 208 and the left frame section 104 is difficult to install because the plate 208 must be inserted-and held by hand or tape in place while being screwed into the frame.

Another drawback is the frame component width (left to right in FIG. 2A/B) is set to match a predefined combination of a common wall width and a common drywall width. If the width of wall stud 218 is wider than the corresponding width of frame side 104 such as shown in FIG. 2C, then additional distance needs to be made up with a drywall extension 260. This complicates installation as the plate 208 and recess 206 are inaccessible, forcing the use of other installation methods. The finished product will have a combination of metal at 262 and drywall at 264, for which the lack of metal along the entire width of the frame and the corresponding combination of metal plus painted drywall creates an unstable joint which is prone to cracking, and an undesirable visual aesthetic for modern décor. The corresponding rear inner facing corner 266 of the frame is also made of mud and/or tape, and will thus have the rounded/uneven shape that is an undesirable visual aesthetic for modern décor.

Yet another drawback is that modern décor style often involves creating gaps around door frames. These are made by channel components known as "reveals," such as shown in FIGS. 19A and 19B, which are laid across the edges of the frame as shown in FIG. 20. As seen in FIG. 20, the distance D1 between the reveal 1002 and the inner edge of the front door frame is different from the distance D2 between the reveal 1002 and the inner edge of the front door frame. This distance is discernable to the naked eye and an undesirable visual aesthetic in modern décor.

BRIEF DESCRIPTION OF THE DRAWINGS

Various embodiments in accordance with the present disclosure will be described with reference to the drawings, in which.

Figure 1:
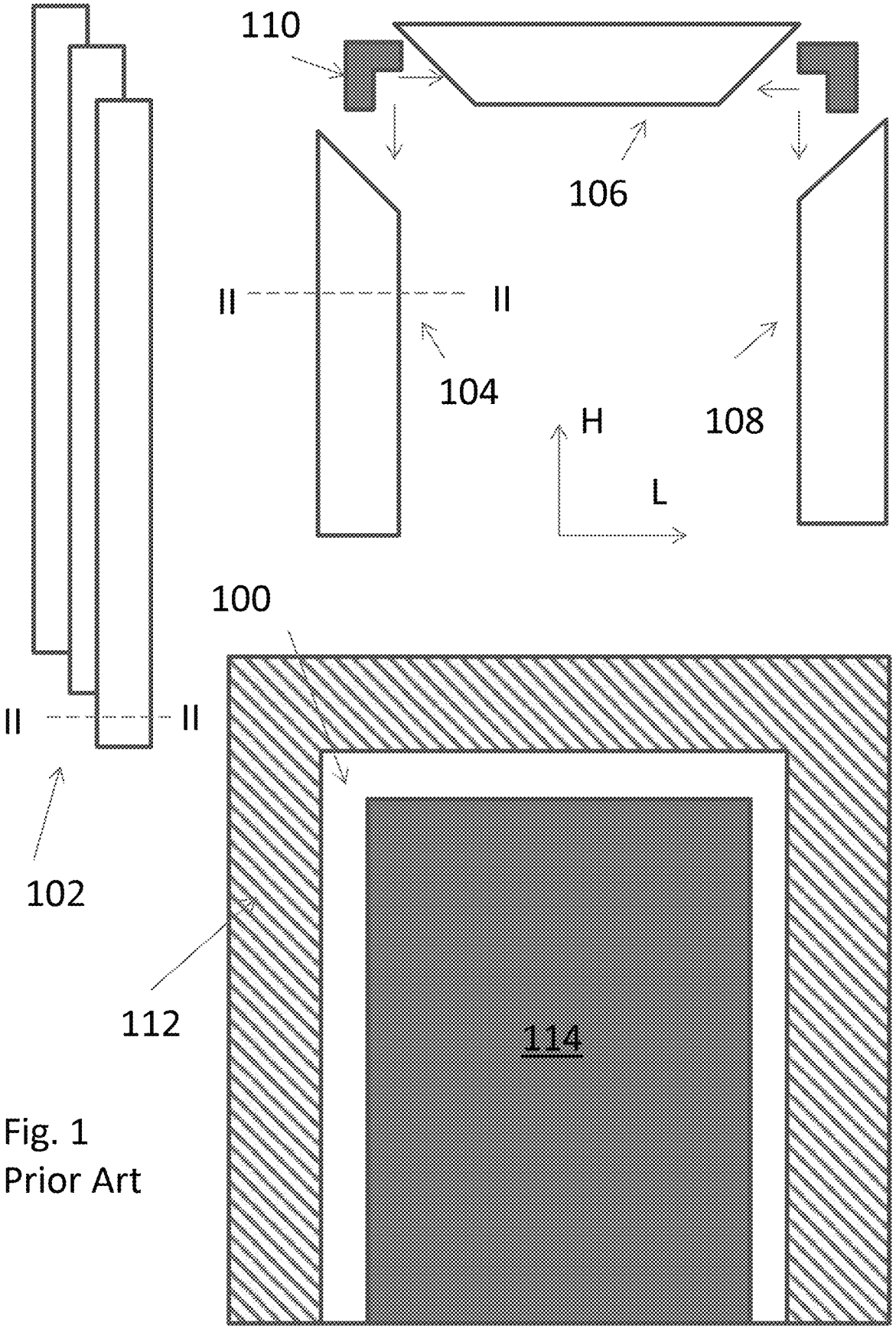
Fig. 1 Prior Art
FIG. 1 illustrates a front view of an overall configuration of door frame components for installation.
Figure 2A:
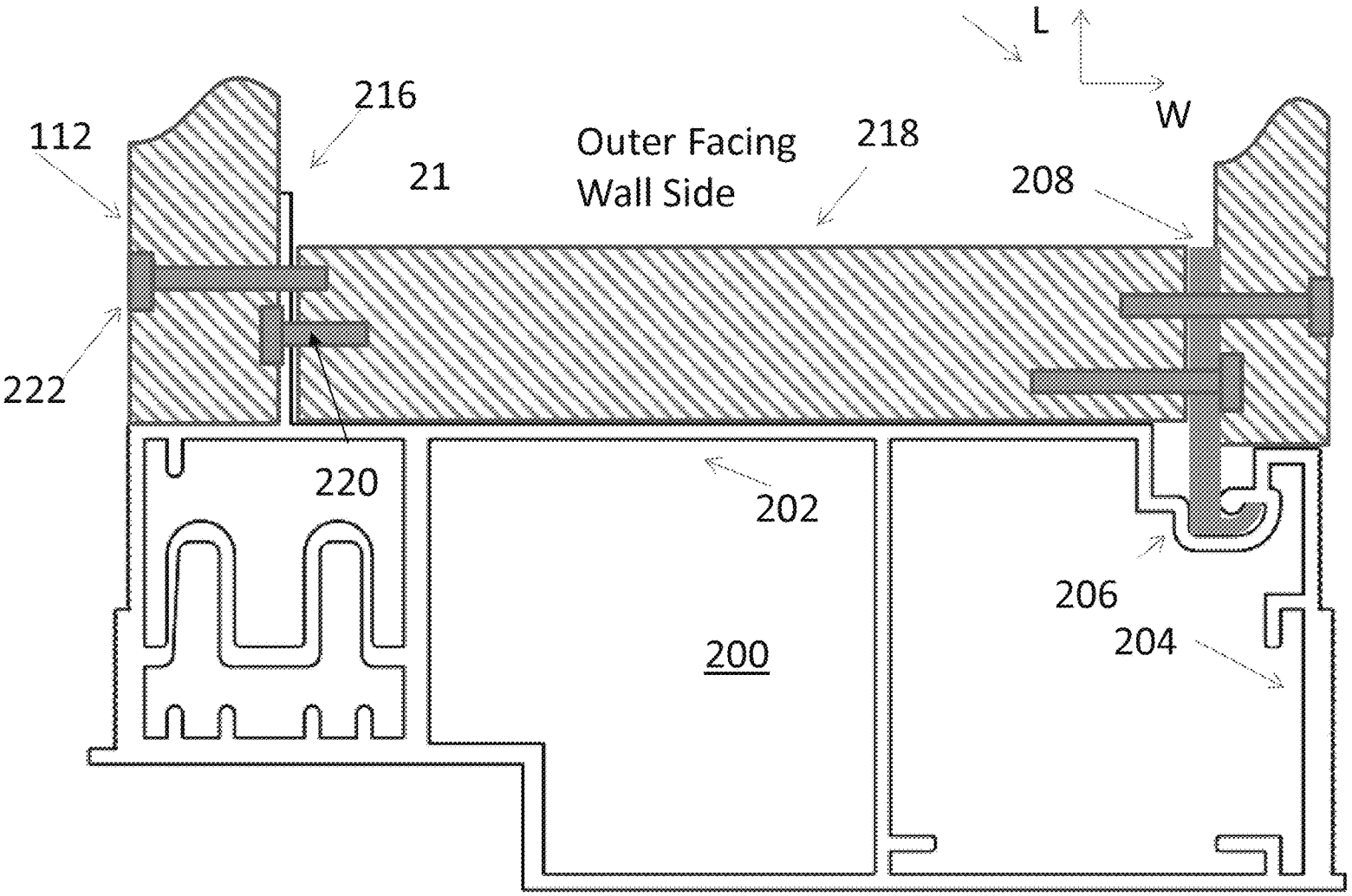
Fig. 2A Prior Art
FIGS. 2A and 2B are to-scale cross sections of prior art frame components.
Figure 2B:
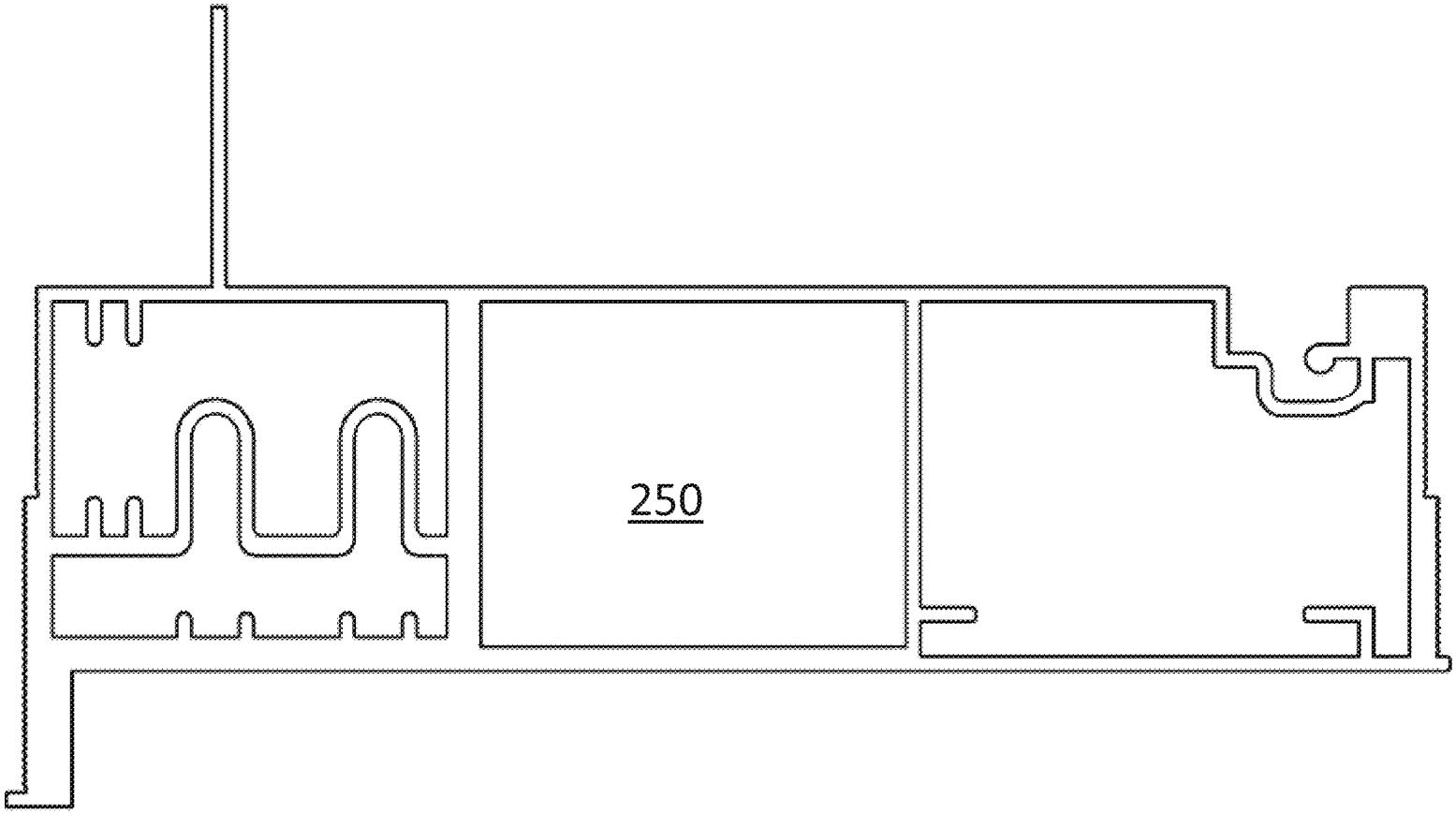
Fig. 2B Prior Art
Figure 2C:
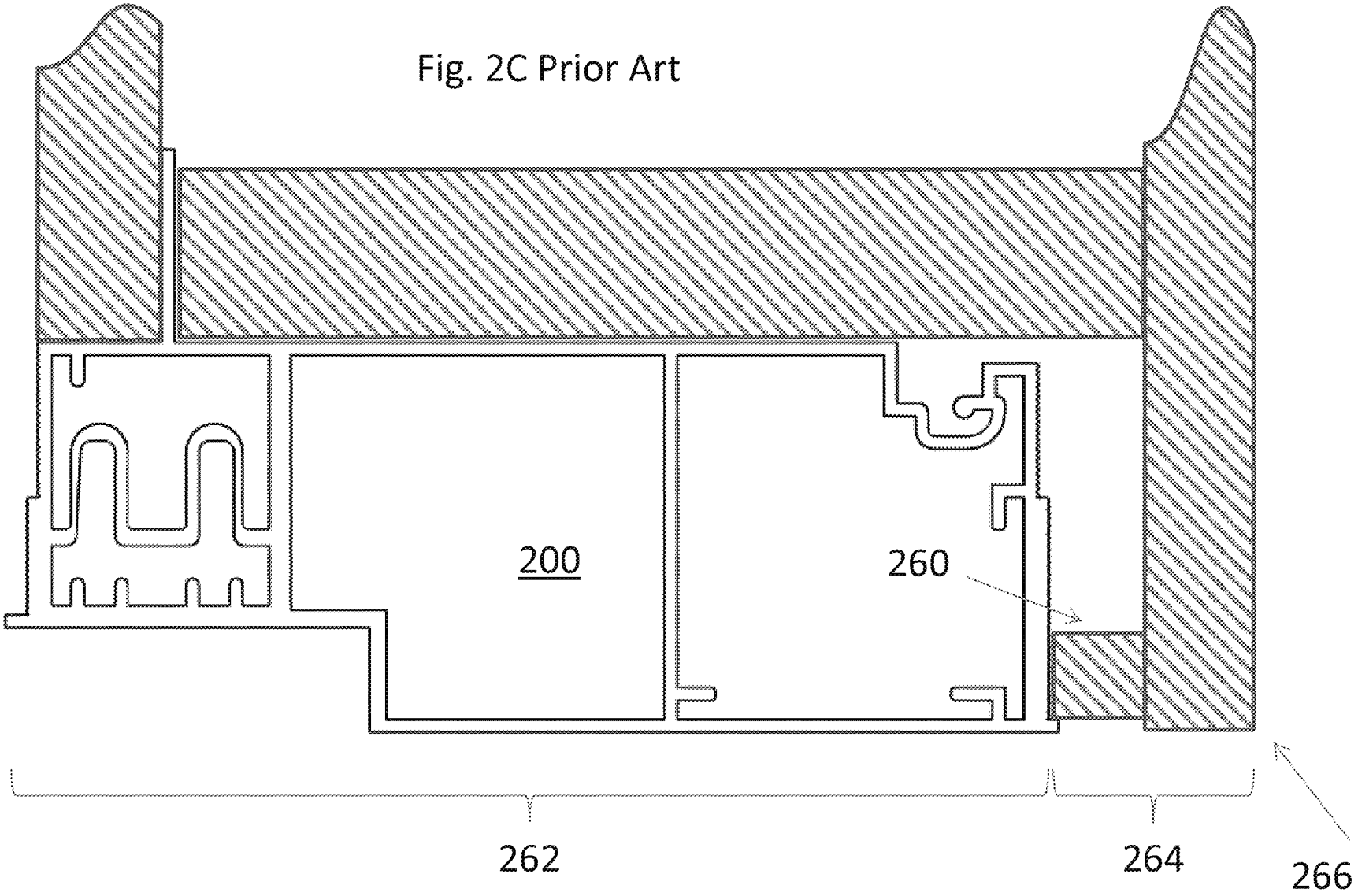
Fig. 2C Prior Art
FIG. 2C is a frame component of FIG. 2A relative to a wide wall stud.

All depictions of cross sections and perspective views of frame components in the drawings are to scale. Depictions of components that interact with the frame components are not to scale.

DETAILED DESCRIPTION

In the following description, various embodiments will be illustrated by way of example and not by way of limitation in the figures of the accompanying drawings. References to various embodiments in this disclosure are not necessarily to the same embodiment, and such references mean at least one. While specific implementations and other details are discussed, it is to be understood that this is done for illustrative purposes only. An individual skilled in the relevant art will recognize that other components and configurations may be used without departing from the scope and spirit of the claimed subject matter.

Several definitions that apply throughout this disclosure will now be presented. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. Distances or sizes referred to as "substantially the same" are less than about ±5%, preferably less than about ±3%, particularly less than 0.01 inch variation, and most particularly identical to thousands of an inch scale.

The term "comprising" when utilized, means "including, but not necessarily limited to"; it specifically indicates open-ended inclusion or membership in the so-described combination, group, series and the like. The term "a" means "one or more" absent express indication that it is limited to the singular. "First," "second," etc., are labels to differentiate like terms from each other, and does not imply any order or numerical limitation.

Various dimensions are used herein for purposes of convenience. "Front" or "front side" refers to end of the frame that supports the door, while "rear" or "rear side" refers to the opposite side of the frame from the front. "Inwardly facing" refers to a part of the frame facing the interior cavity defined by the frame in which the door is mounted, while "outwardly facing" refers to a part of the frame opposite the "inwardly facing" and facing the wall stud that supports the frame. An "inwardly" opening door moves from the front of the frame toward the rear, while an "outwardly" opening door moves from the front away from the frame.

Objects herein have dimensions of height, length and width. In commonly understood parlance these may not align between components, e.g., the height of a wall can also be thought of as a length of a frame along the wall. For avoidance of confusion, "height" refers to the floor to ceiling direction, "length" refers to the lateral side-to-side direction across the wall, door and frame, and "width" refers to the front-rear direction across the span of the frame (e.g., door thickness is in the direction of "length"). Length as a dimension is distinct from length as a distance (e.g., the material has a length of six inches")

Figure 3:
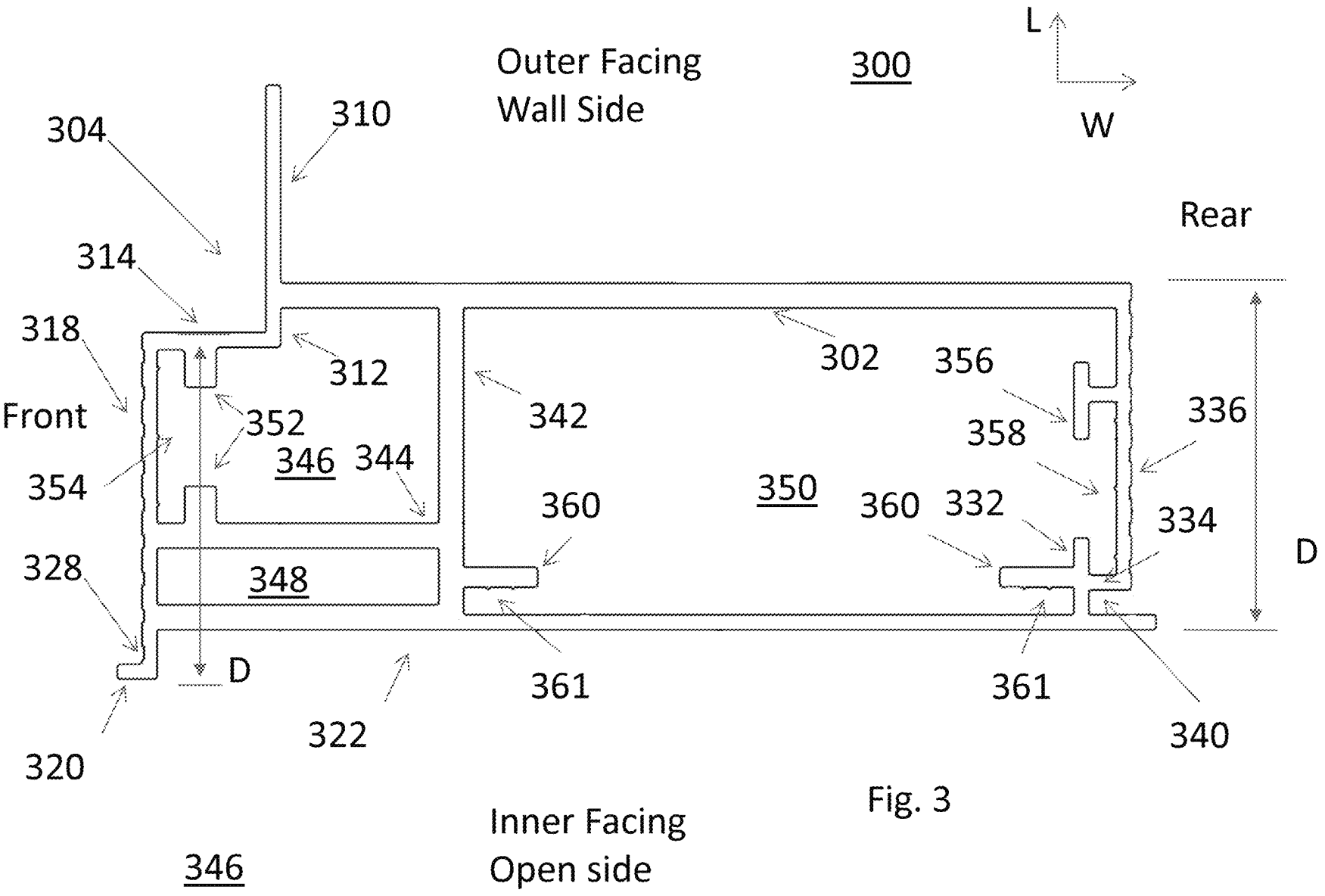
FIG. 3 is a cross section of a frame component for an inwardly opening door according to an embodiment of the invention.
Figure 4:
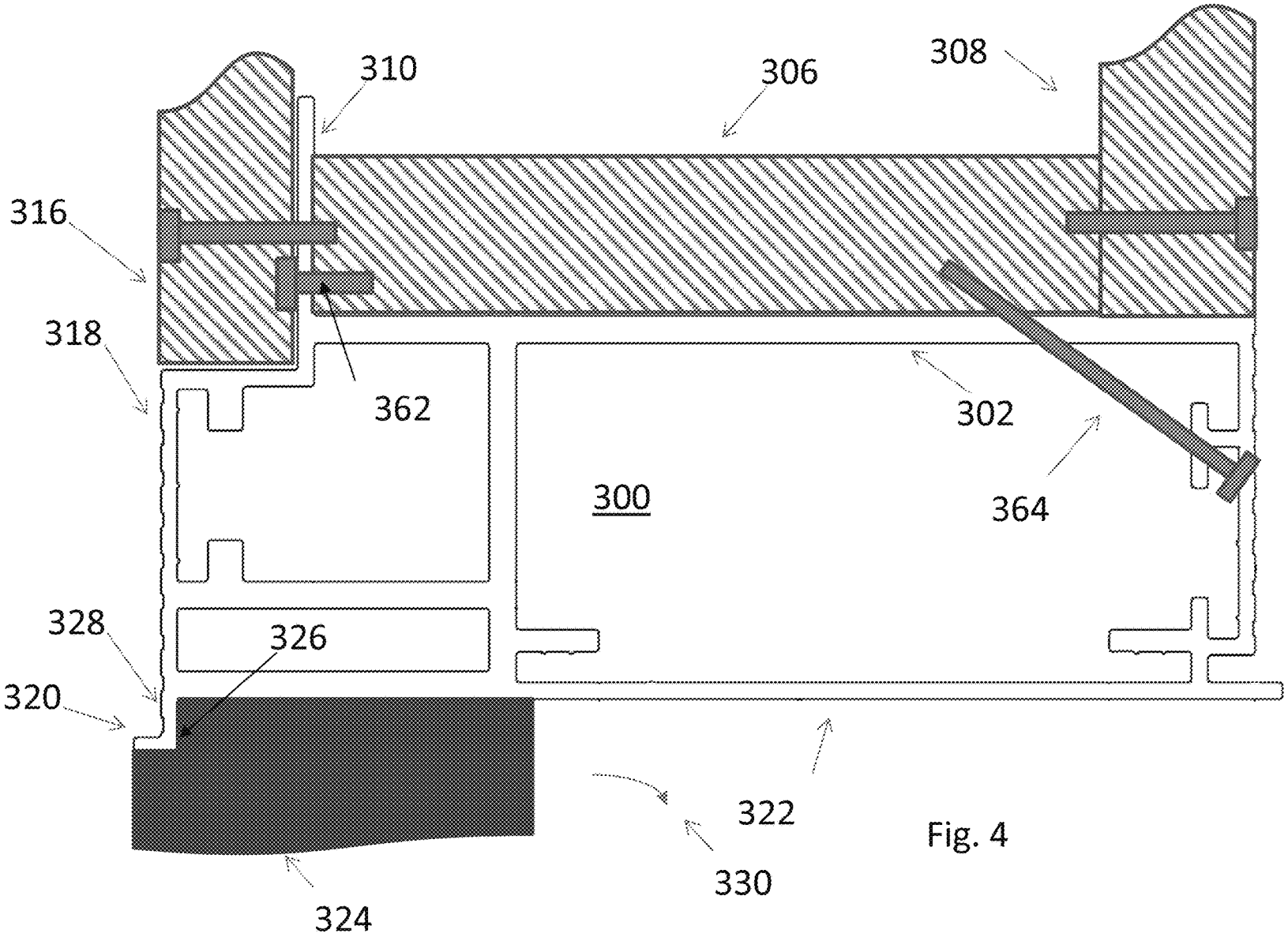
FIG. 4 is a cross section of the frame component of FIG. 3 partially mounted in a wall frame.
Figure 16A:
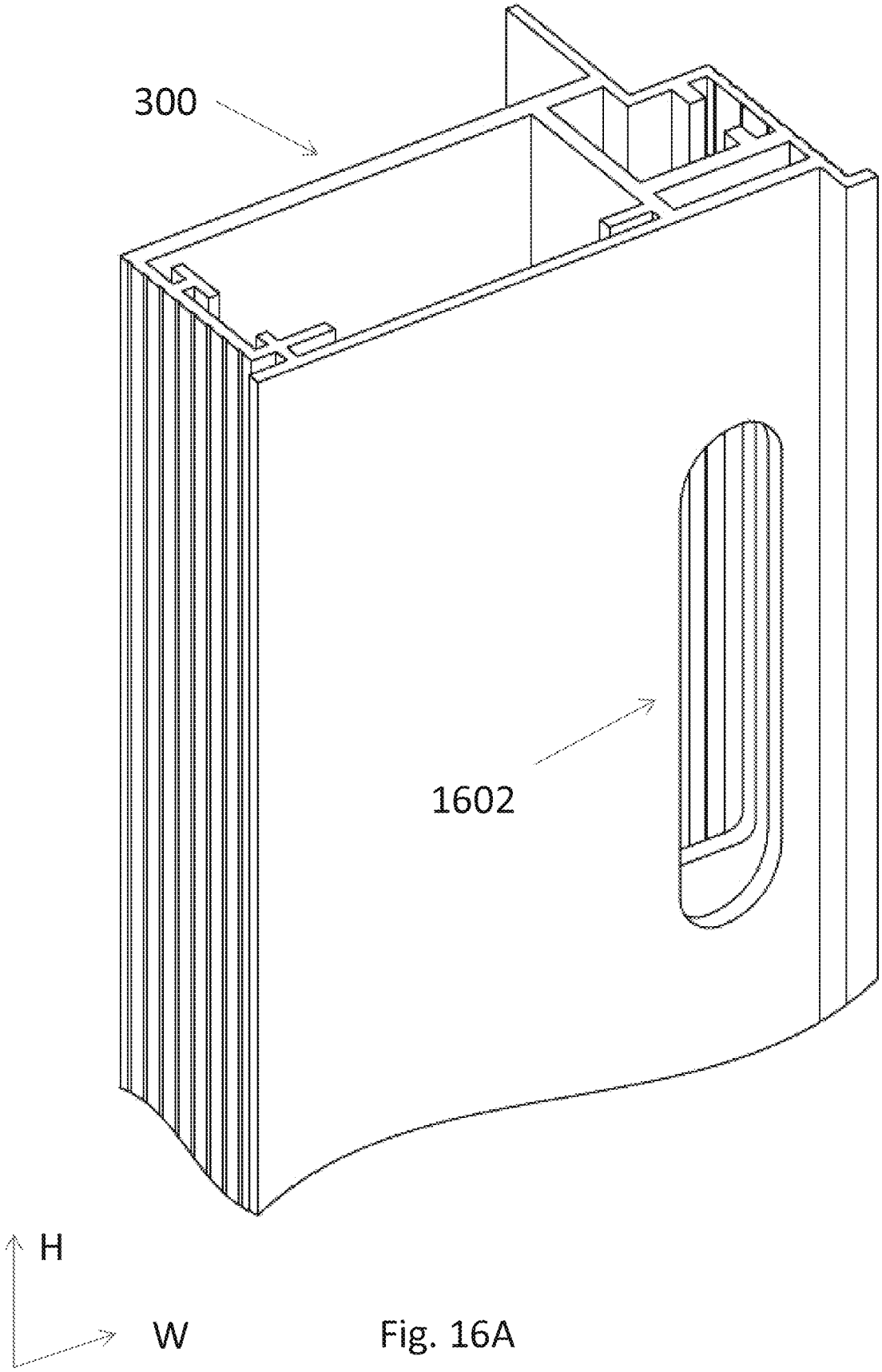
FIGS. 16A and 16B are perspective top oriented views of the frame component of FIG. 3.
Figure 16B:
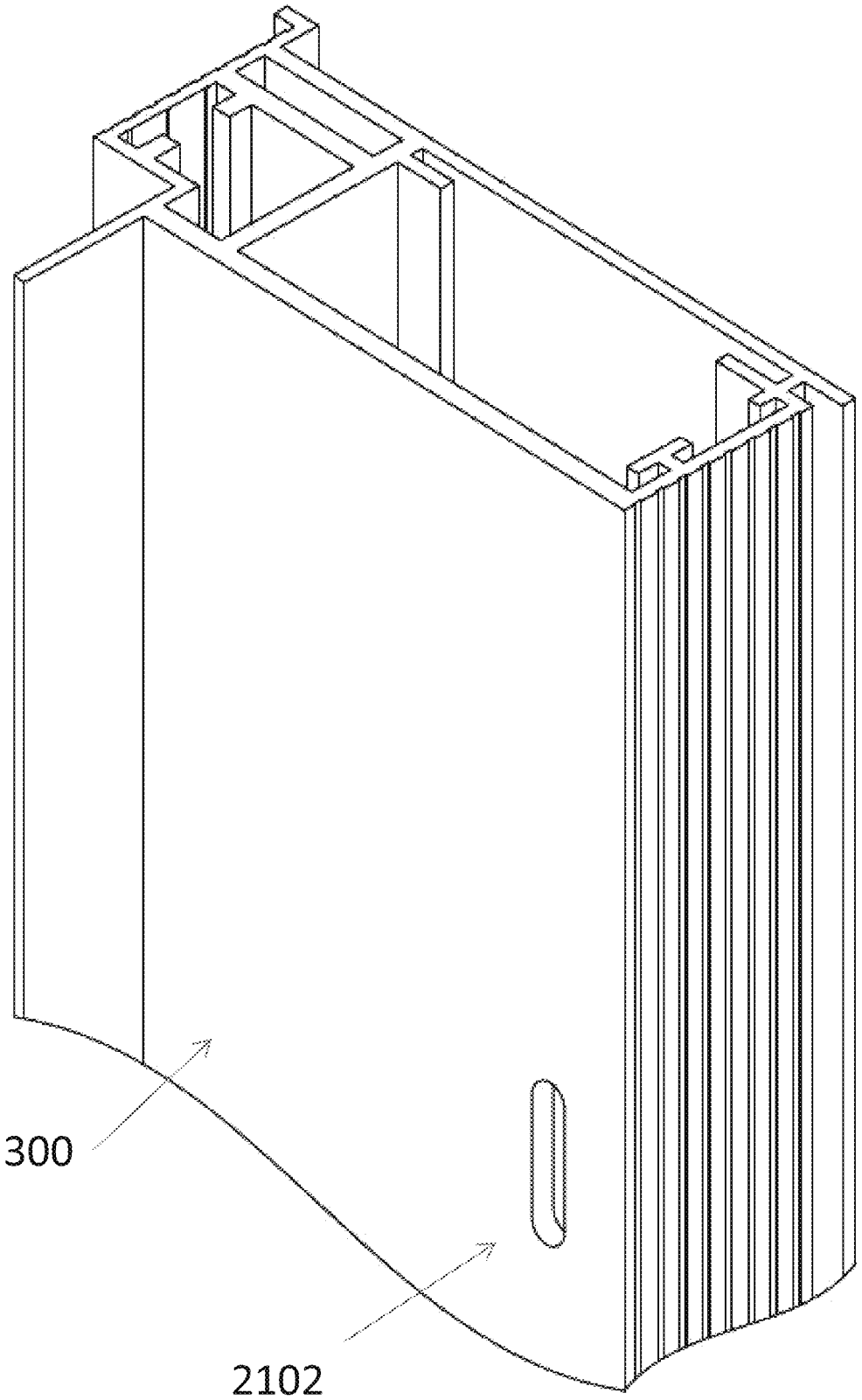
Figure 17A:
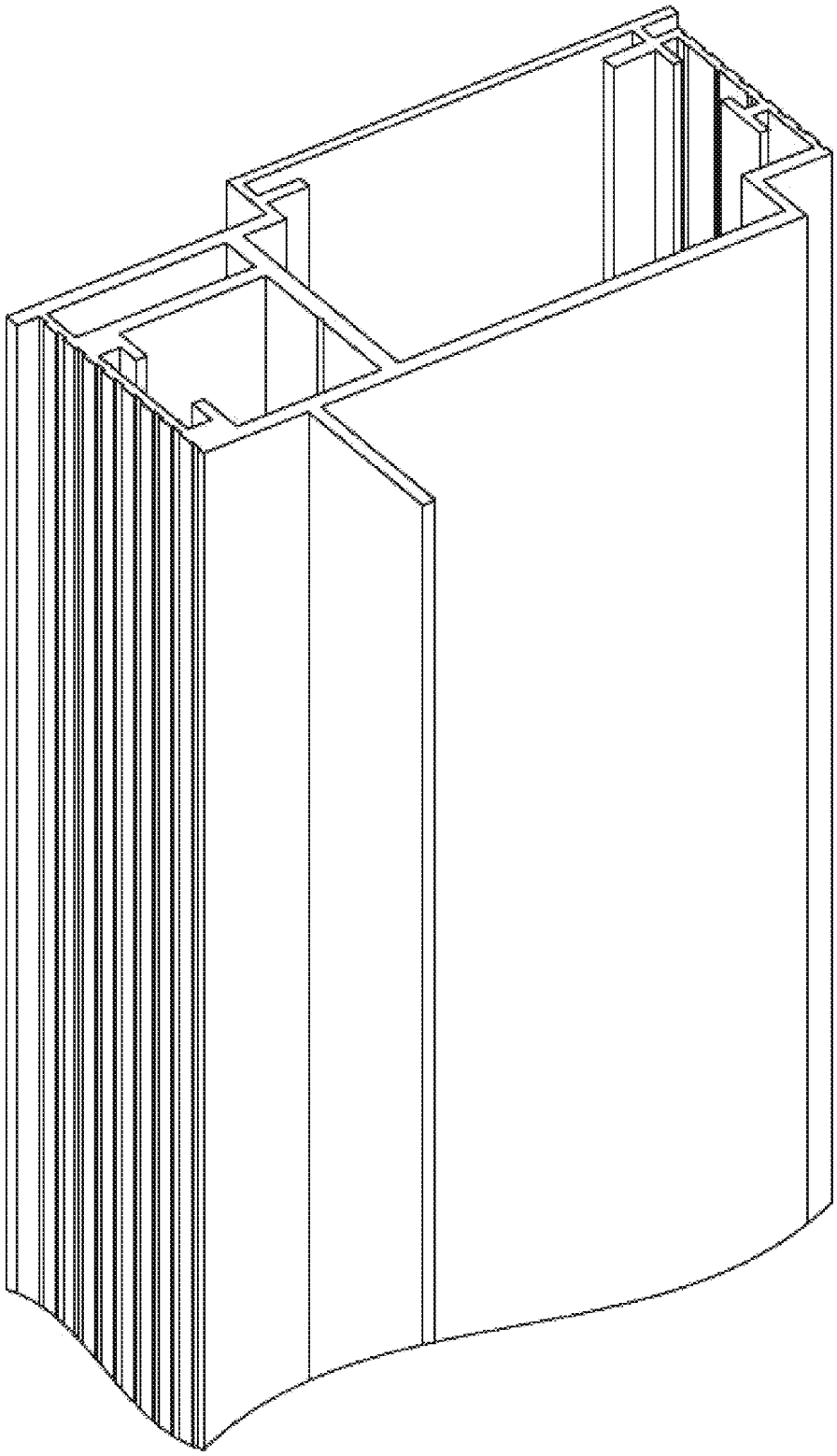
FIGS. 17A and 17B are perspective top oriented views of the frame component of FIG. 3.
Figure 17B:
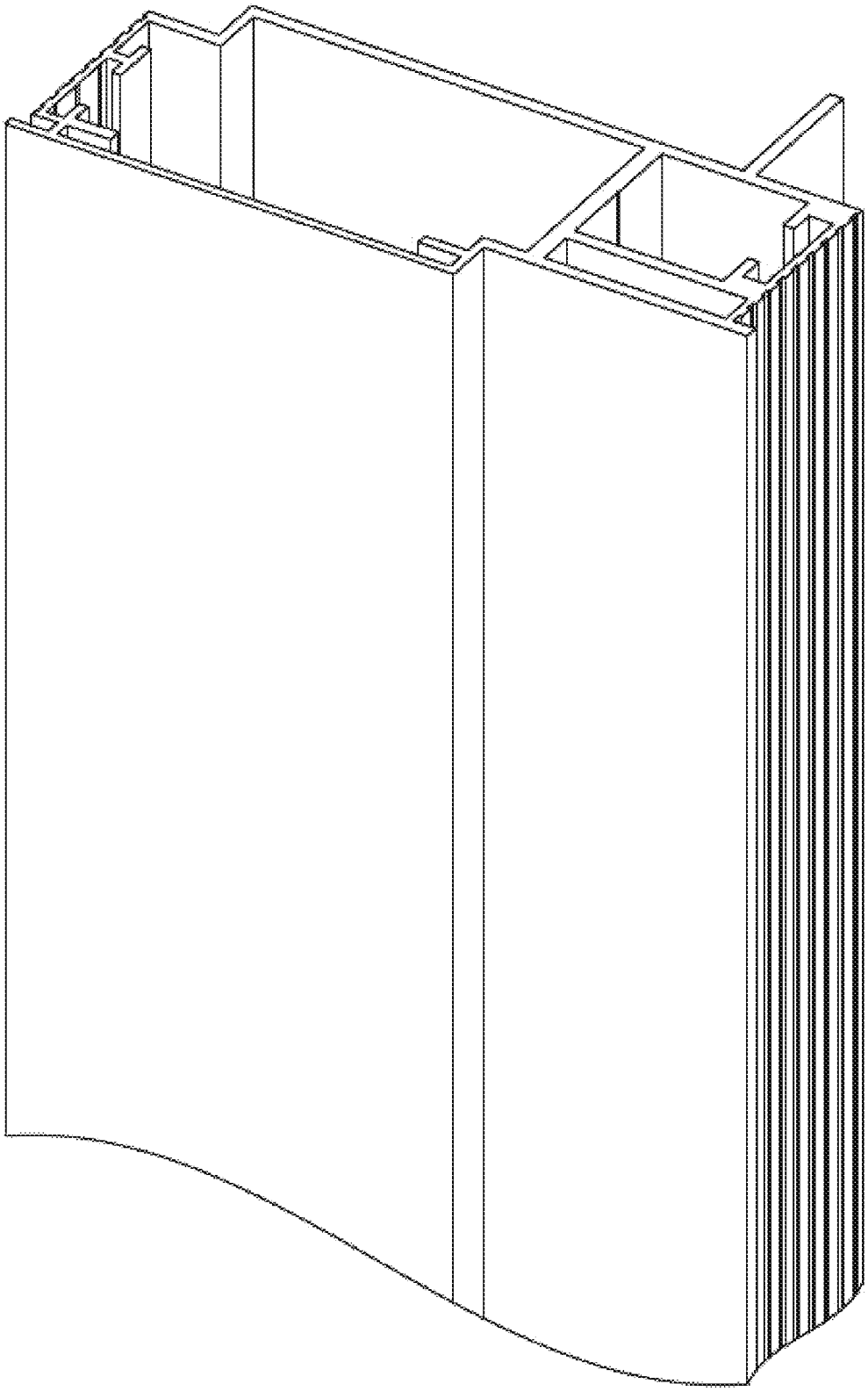

Referring now to FIGS. 3, 4, 16A and 16B, an embodiment of a frame component 300 for an inwardly opening door is shown. FIG. 3 shows the cross section of the frame component, while FIG. 4 shows the cross section as installed within the surrounding structure on the latch side of the door. FIGS. 16A and 16B show other views of the frame component.

An outwardly facing wall 302 extends from the rear of frame component and transitions to outwardly extending flange 310 and inwardly extending flange 312. The outer surface of wall 302 and the rear facing surface of outwardly extending flange 310 will mate with wall stud 306. The width of the outwardly facing wall 302 may be set to match the expected combined width of the stud 306 and thickness of the drywall 308 (e.g., based on in industry standards for the same, such as ⅝" or ½", although the invention is not so limited), and may also account for shims or other known intervening components. Outwardly extending flange 310 is preferably longer than the thickness (width) of wood stud 306, but this need not be the case. FIG. 4 shows wood stud 306 nestling against wall 302 and flange 310, although in practice wood may not be cut to perfect size and intervening shims (not shown, and to be considered part of the wall stud 306) may be inserted to create a level fit.

Inwardly extending flange 312 terminates at a wall 314 that extends parallel to wall 302. Wall 314 in combination with inwardly extending flange 312 and outwardly extending flange 310 define a drywall receiving area 304 for front drywall 316. Wall 314 is preferably wide enough to match the expected thickness of front drywall 316, but this need not be the case; and intervening shims (not shown, and to be considered part of the front drywall 316) may be inserted to create a level fit.

Wall 314 terminates at a forward facing wall 318 with ridges (discussed in more detail below). Forward facing wall 318 terminates in a forward extending flange 320.

An inner exposed side wall 322 extends from the rear side of forward facing wall 318 to the rear of the frame component. A door 324 with a notch 326 nestles against wall 322 in combination with the flange 320 and the intervening portion 328 of wall 318. The door opens inward as shown by arrow 330 on the latch side. The intervening portion 328 of wall 318 acts as a door stop such that the front of door 324 is flush with the forward most portion of flange 320.

A rearward facing wall 332 extends from inner side wall 322 near the rear of frame component. A flange 334 extends from rear facing wall 332 and terminates in a rear wall 336. Rear wall 336 terminates at side wall 302.

A portion of inner side wall 332, inner facing wall 332, and flange 334 collectively define a jam extension recess 340 described in more detail below. The distance D between side walls 302 and 322 may be substantially the same (e.g., less than ±5%, preferably less ±3%, particularly less than 0.01 inch variation, and most particularly identical to thousands of an inch scale) as the distance between wall 314 and flange 320.

The various outer peripheral components define an inner region. Interior walls 342 and 344 separate the inner region into a first interior region 346, a second interior region 348 and a third interior region 350. Inwardly facing flanges 352 in first region 346 define a first corner key slot 354. The far end of inner side wall 332 and a flange 356 in third region 350 define a second corner key slot 358. Lateral flanges 360 along with wall 322 define expansion grip region sections 361, discussed in more detail below.

Referring now to FIG. 4, the frame component 300 is shown as installed for wall components of matching size and without any reveals, and for which shims (not shown) may be present. Outwardly extending flange 310 is screwed into stud 306 (often 18 gauge, although the invention is not so limited) by a screw 362 to secure the front of frame component to stud 306. A screw 364 is inserted on a diagonal through walls 332 and 302 to secure the rear of frame component to stud 306. Front drywall 316 is placed in the drywall receiving area 304 and screwed into stud 306 through outwardly facing flange 310. Rear drywall 308 is mounted against outwardly facing wall 302 and stud 306, and screwed into stud 306.

Figure 5:
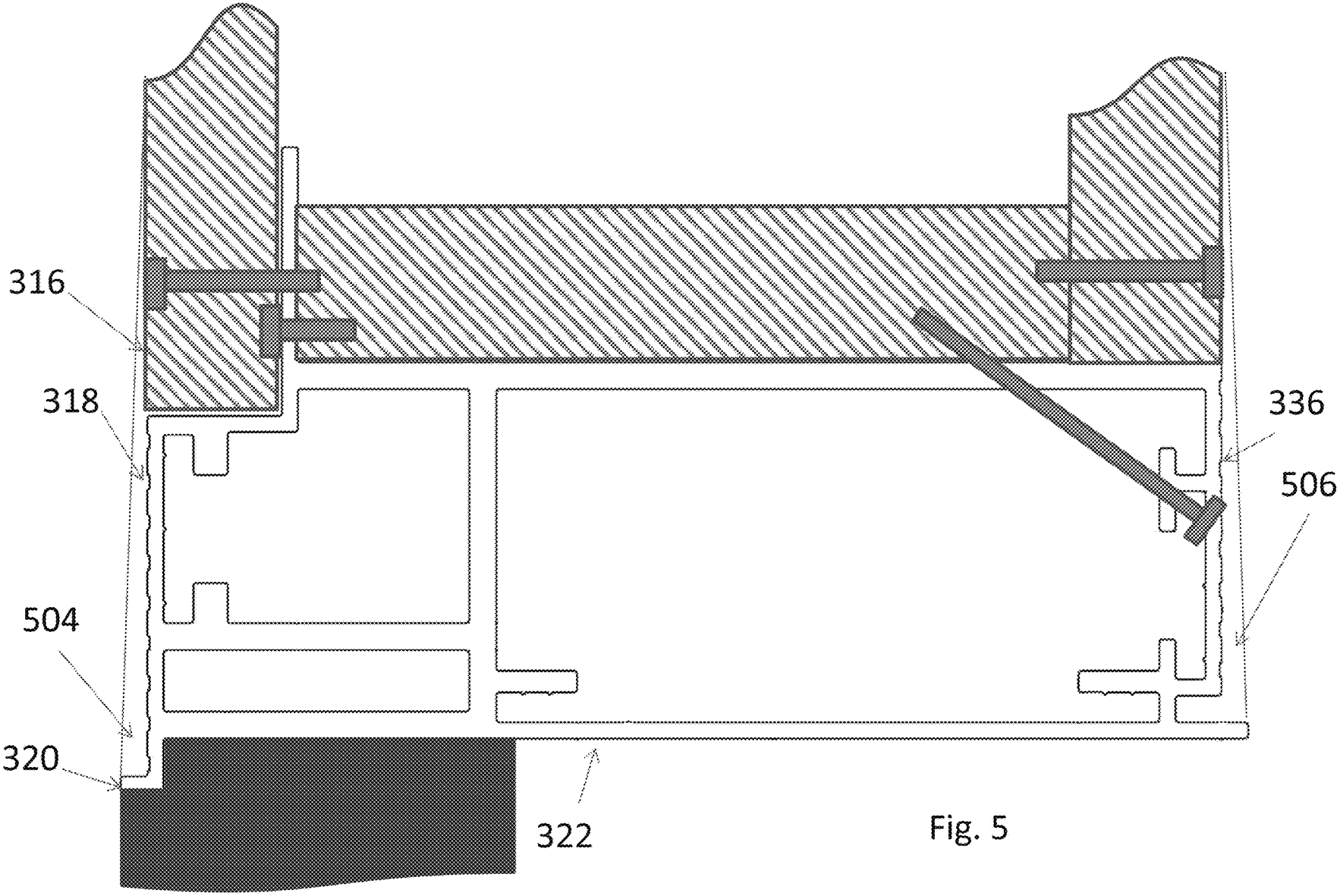
FIG. 5 is a cross section of the frame component of FIG. 3 mounted in the wall after full assembly.

Referring now to FIG. 5, drywall joint compound 504 is applied on the front of forward facing wall 318 extending from forward facing flange 320 to front drywall 316, tapering off as it extends over drywall front drywall 316. Drywall joint compound 506 is applied on the rear of rear facing wall 336 extending from wall 322 to rear drywall 308, tapering off over rear drywall 308. (The tapering is not to scale in FIG. 5.) Bonding agent, such as LARSEN PLASTER-WELD, is applied to both 318 and 336 then drywall tape is applied to the seams before application of the drywall joint compound.

Figure 6:
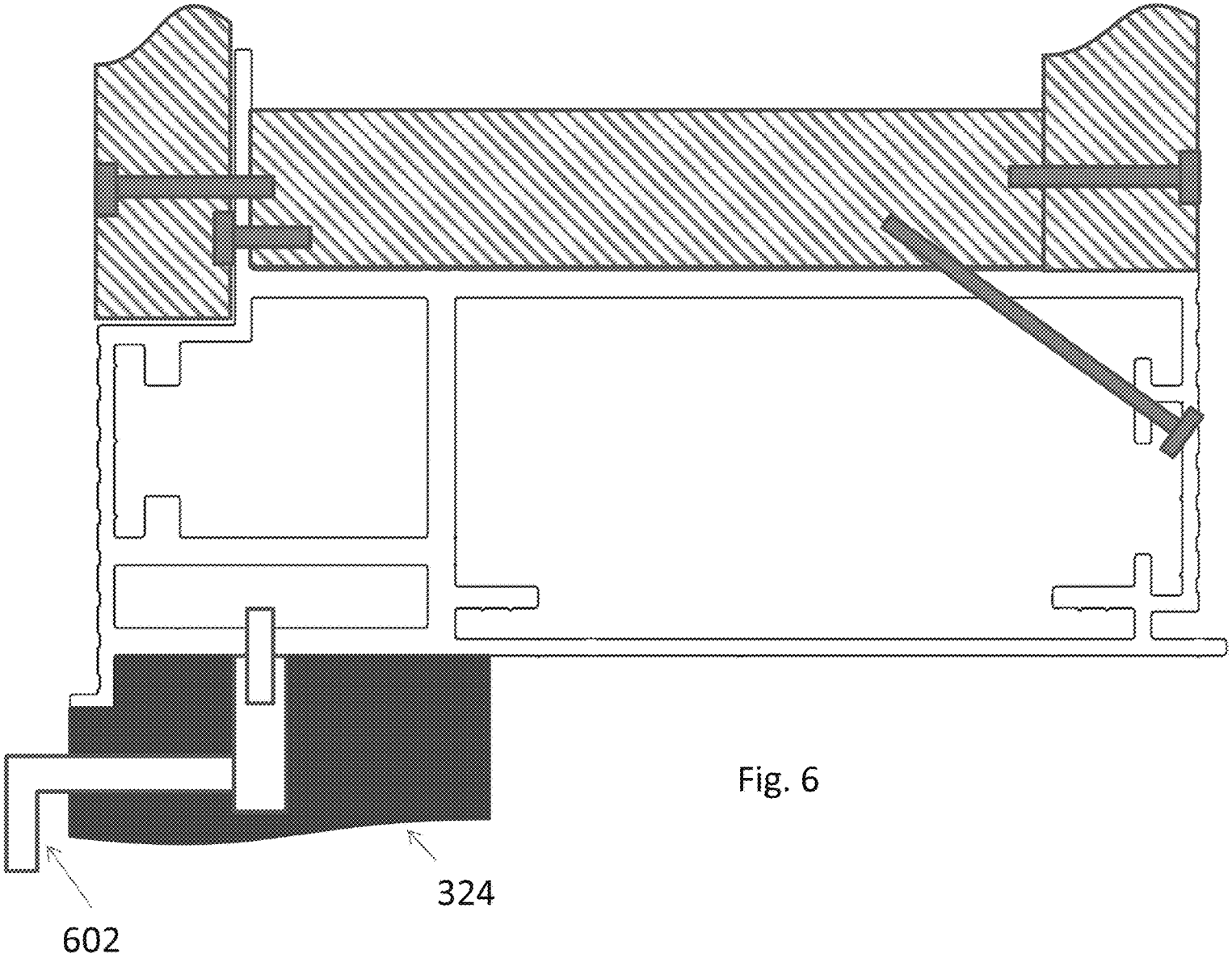
FIG. 6 is a cross section of a frame component for an inwardly opening door taken through a door handle according to an embodiment of the invention.

Referring now to FIG. 6, frame component is shown through a different cross section, taken through a handle and latching mechanism 602 of the door. A recess as is known in the art can be drilled through wall 322 into interior region 348 to accommodate a door latch from latching mechanism 602.

Figure 7:
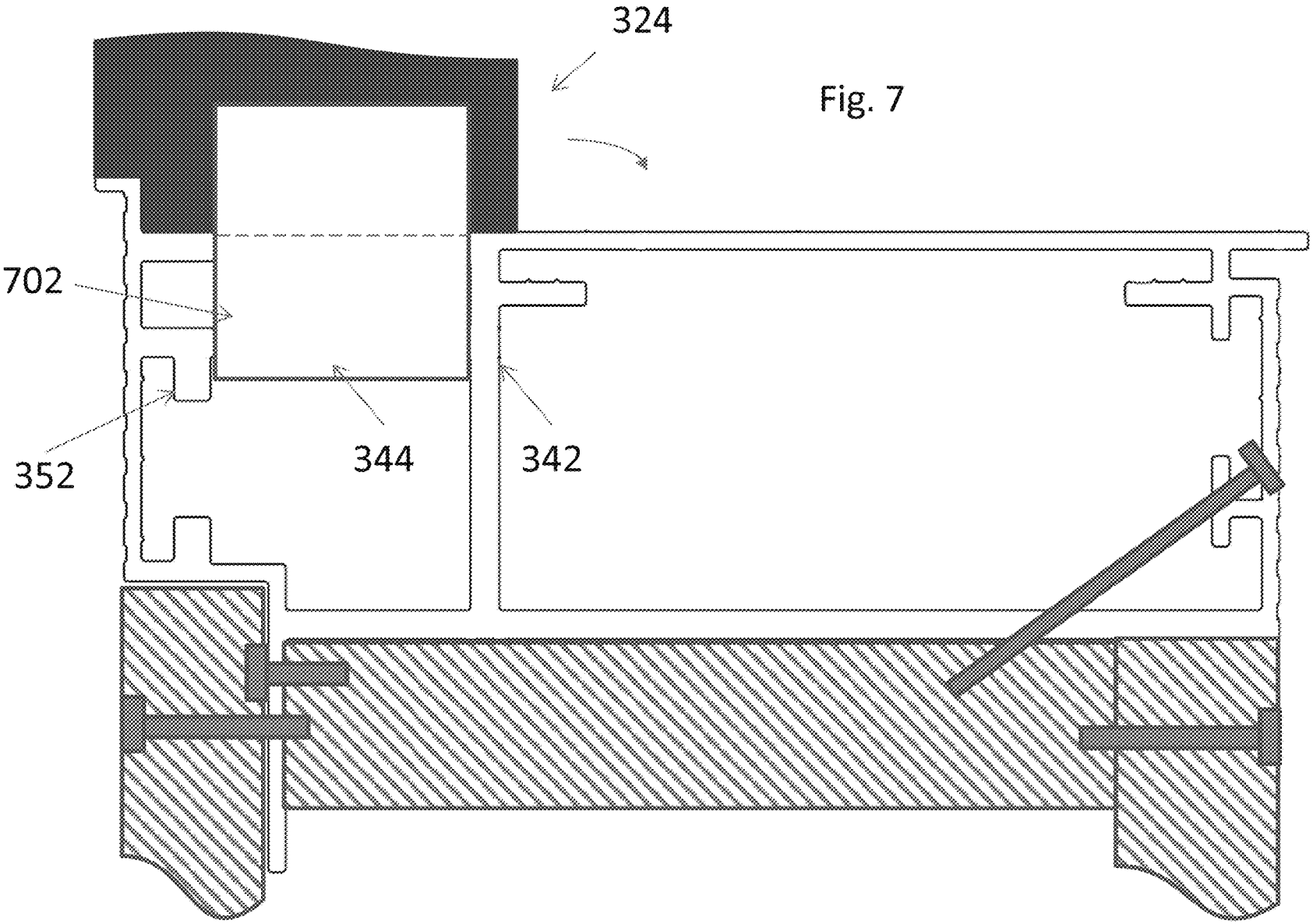
FIG. 7 is a cross section of a frame component for an inwardly opening door taken through a hinge according to an embodiment of the invention.

Referring now to FIG. 7, the door frame component is shown from the hinge side through a cross section taken through a connecting door 324 and frame component 300 to show a hinge 702. Any hinge 702 may be used, but consistent with the concealed décor style recessed hinges are preferred for their sleek look and minimal edges. A non-limiting example of an appropriate hinge is TECTUS 340d Recessed Hinge, although the invention is not so limited. In one embodiment, a recess opening 1602 (FIG. 16A) as is known in the art can be machined through wall 322 into interior region 348 to accommodate a recess hinge 702 as is known in the art. In another embodiment such as shown in FIG. 7, the recess opening may additionally be machined through wall 344 into interior region 346 to accommodate recess hinge 702 as is known in the art; interior walls 342 and 352 provide lateral stability for interior mounting of hinge 702.

As discussed above, prior art frames are designed for a fixed width of walls as commonly found in the industry. There are a variety of reasons that the wall may not be industry standard, such as an unusually wide wall stud, intervening pipers or support columns, etc. In the prior art this was compensated for by adding drywall and supporting wall studs, which resulting in a frame made from different materials and which will have uneven corners at the drywall. Frame component 300 overcomes this by providing the ability to extend the metal frame, thereby preserving the use of common materials and sharp corners for modern decor.

Figure 8:
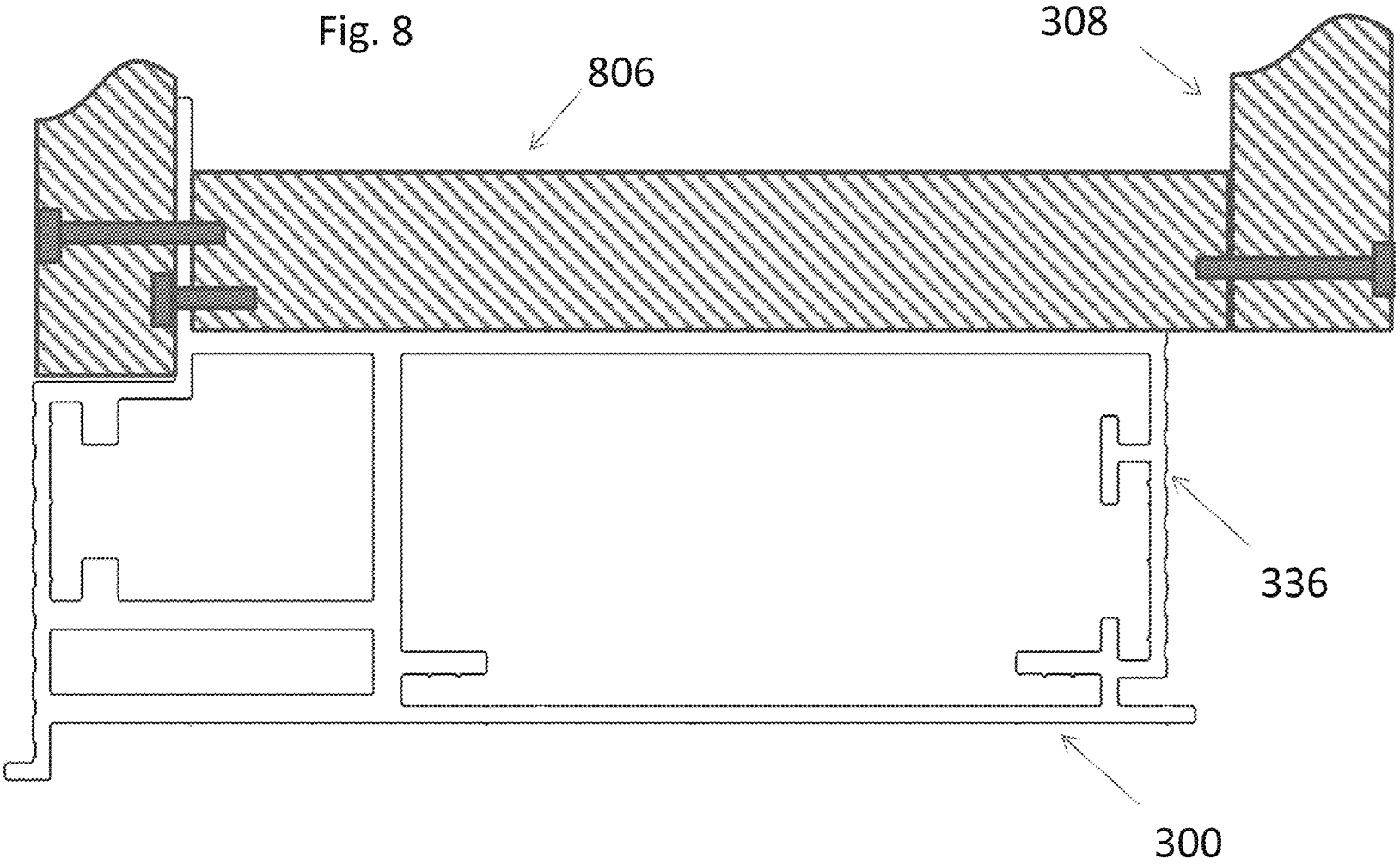
FIG. 8 is a cross section of a frame component for an inwardly opening door according to FIG. 3 as shown relative to a frame larger than the frame component.

Referring now to FIG. 8, the need for an extension shown by way of non-limiting example the presence of an unusually wide wall stud 806, such that the frame component 300 does not extend as far back as drywall 308.

Figure 9:
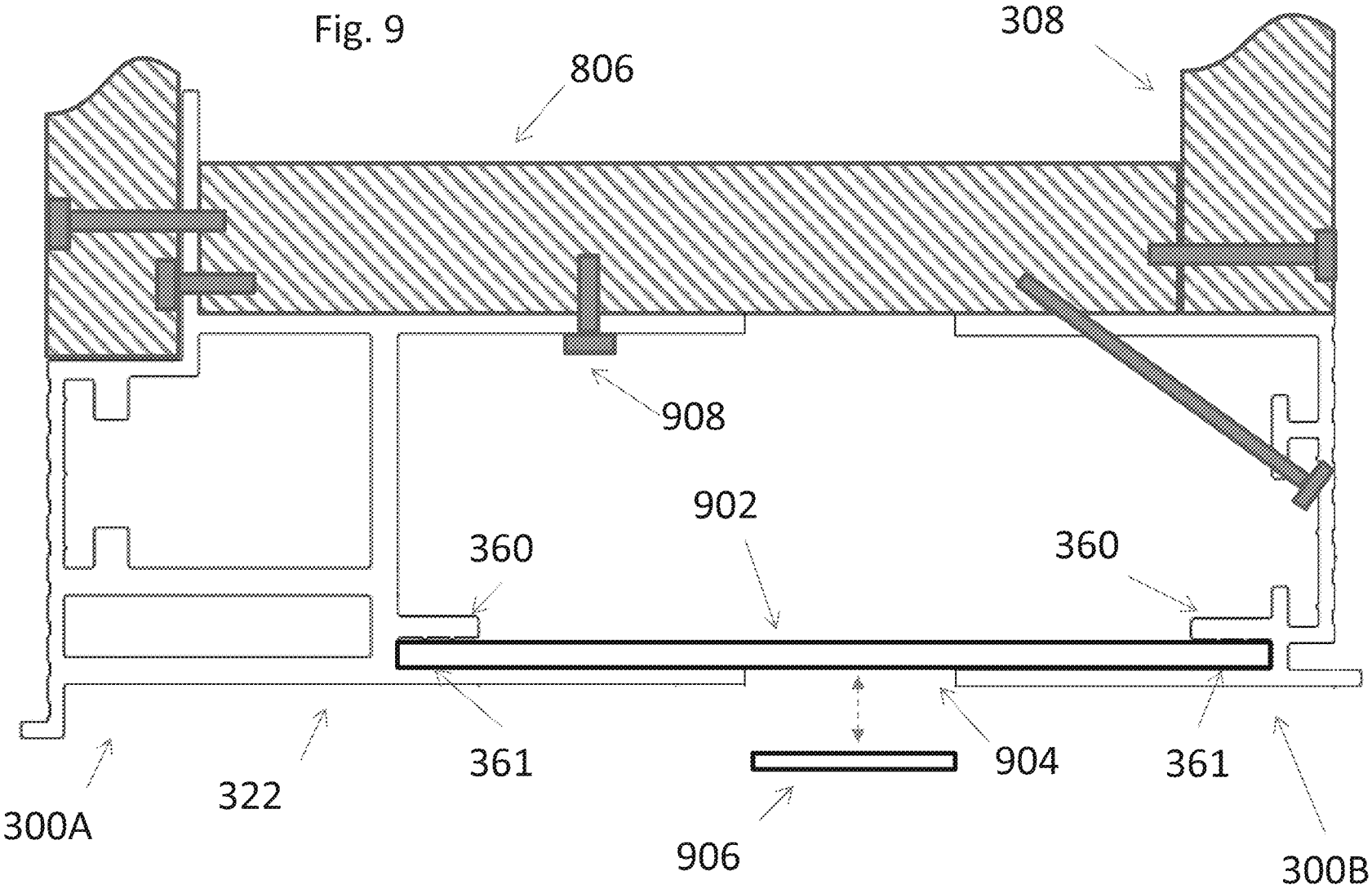
FIG. 9 is a cross section of a frame component for an inwardly opening door according to FIG. 3 as shown in an embodiment of an extended configuration.

Referring now to FIG. 9, one methodology to extend frame component 300 is to cut it height wise into two sections 300A and 300B, preferably by cutting interior section 350 into substantially equal parts. An intervening extruded plate 902, which preferably is of the same material and visual appearance as frame component, is inserted into the expansion grip region sections 361 defined between wall 322 and flanges 360 to define an extension. Plate 902 has a thickness to fit snugly with the expansion grip region sections 361. Plate 902 may be cut via a CNC machine in height and width from a larger plate to fit the custom needs of the install, although the invention is not so limited and plate 702 may be manufactured to size. The width may be sufficient to bring rear wall 336 into alignment with the face rear drywall 308. The height may run the entire height of the face of frame component 300 that it replaces. Installation is otherwise the same as discussed above, save that additional screws 908 may be added.

If plate 902 is of uniform thickness, the extension methodology in FIG. 9 will leave a gap 904 that may be undesirable for some customers. An additional plate 906, manufactured and cut to size, can be inserted to fill the gap and held in place via adhesive, thereby eliminating gap 904 and leaving only seam lines. In the alternative, plate 902 and plate 904 could be a single tiered plate manufactured or cut to size.

Figure 10:
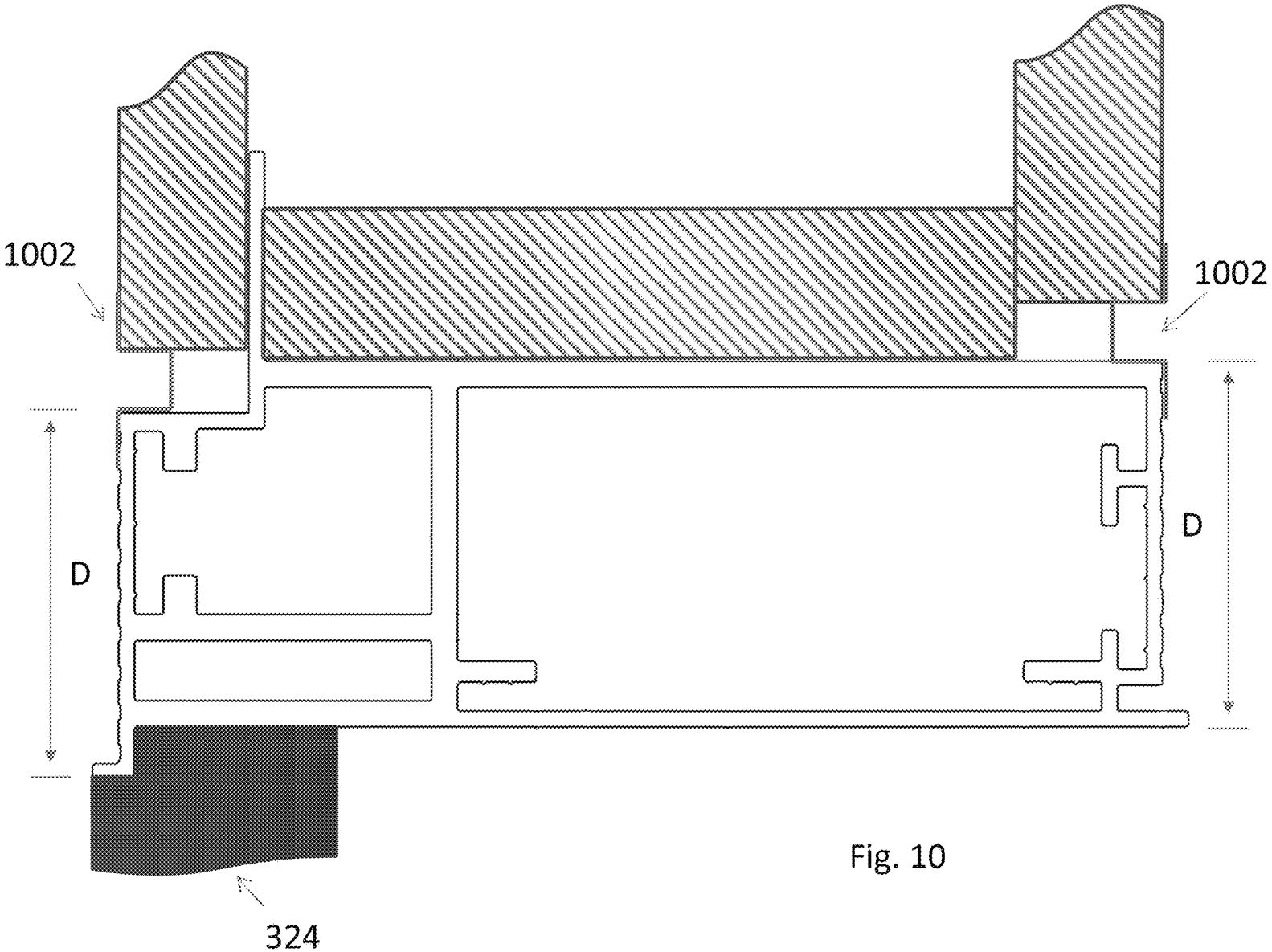
FIG. 10 is a cross section of a frame component for an inwardly opening door according to FIG. 3 as shown with reveals on opposite sides of the frame.

The extension methodology of FIG. 9 is particularly useful when the design includes a reveal. FIG. 10 shows frame component mounted with respect to a reveals 1002 on each side. Since the distance between side walls 302 and 322 is preferably substantially the same as the distance between wall 314 and flange 320, then the distance D between the edge of reveal and the edge of the frame component is also substantially the same. This creates a universal visual appearance on both sides of the door 324, which is desirable for modern décor.

The above methodology can also be used if the frame component 300 is longer than the wall stud, such that the frame component 300 extends further back than drywall 308. In this case, frame component 300 can be cut into three sections, and the middle section is removed. If cut to perfect accuracy, there may be no gap 904, although the two end parts may still be bridged by plate 902 to provide rigidity and strength.

Figure 11:
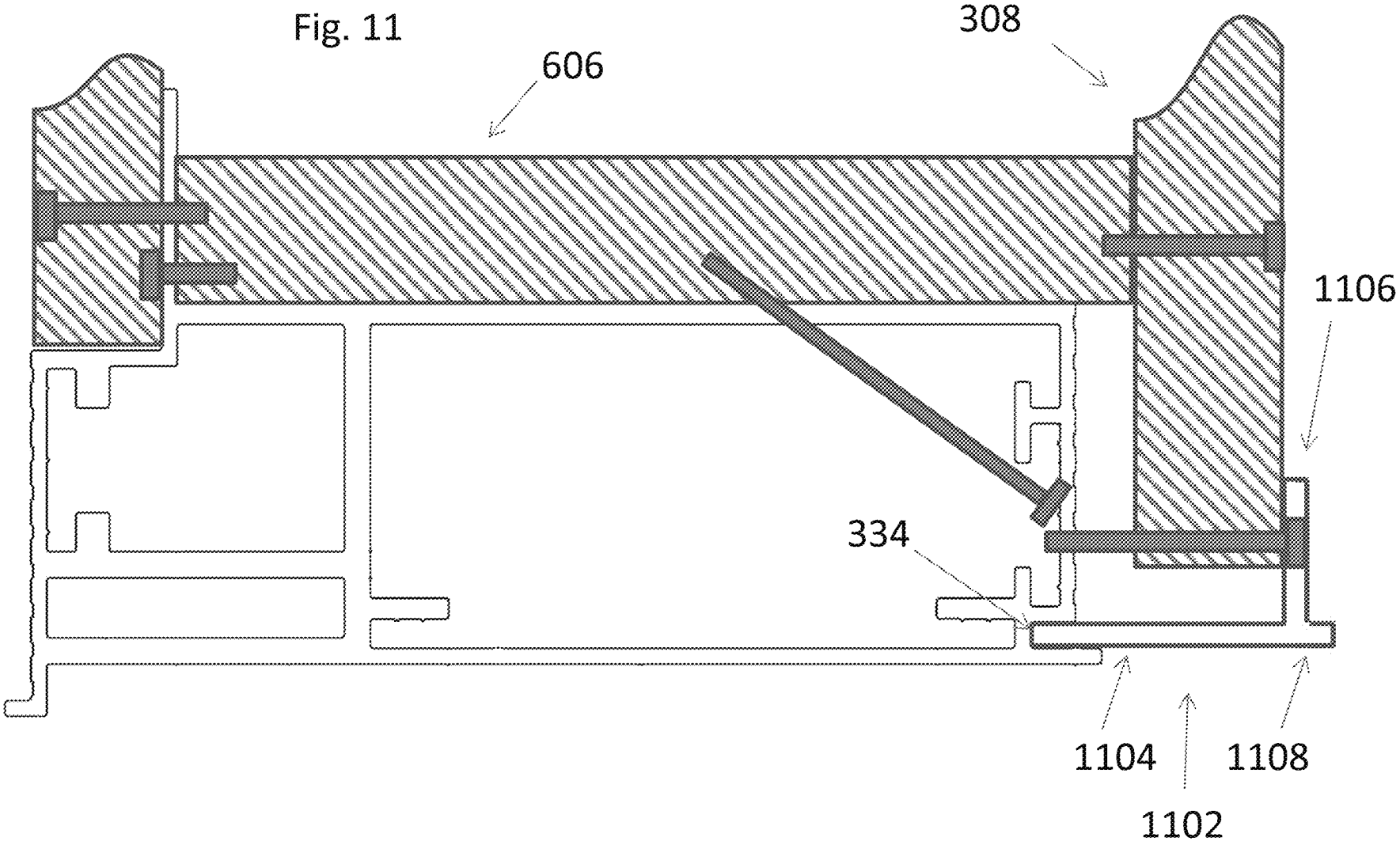
FIG. 11 is a cross section of a frame component for an inwardly opening door according to FIG. 3 as shown in another embodiment of an extended configuration.

The methodology of FIG. 9 is not limited to reveals, and can be used as a general extension methodology. However, in the absence of reveals or other specific need to maintain a uniform edge distance, another methodology that is less complicated to install is shown in FIG. 11. A substantially L-shaped bracket 1102 has a front portion 1104 and a rear portion 1106, and may have a rearward facing protrusion 1108. The inward portion 1104 is cut or manufactured to the desired width to accommodate the width variance, and mounts into recess 334. Rear drywall 308 is mounted further inward to overlap with rear portion 1106, although this need not be the case and rear portion 1106 can be extended to allow for drywall 308 to be in its position as shown in FIG. 8; and the length may be the same length D as the front to present the same metal size on both the front and the back (which as noted above may be particularly preferable if a reveal is needed). Protrusion 1108 if present acts as a lip similar flange 320 to receive drywall compound.

Figure 18:
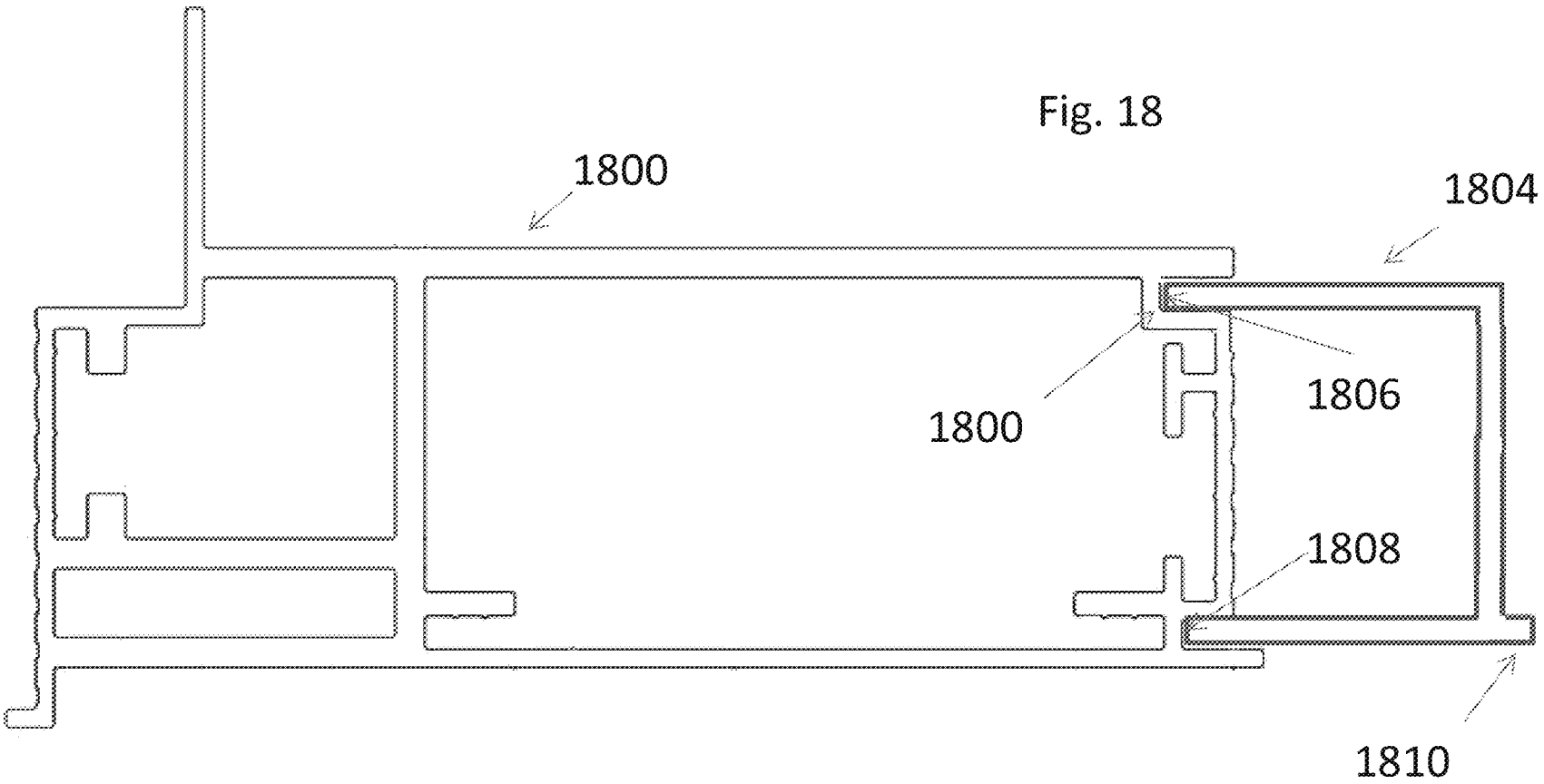
FIG. 18 is a cross section of a frame component for an inwardly opening door according to an embodiment of the invention.
Figure 19A:
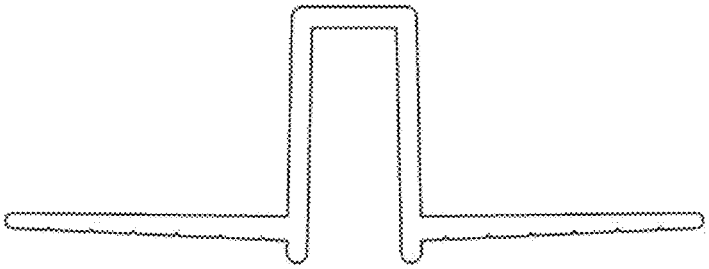
FIGS. 19A and 19B are top and perspective views of a reveal.
Figure 19B:
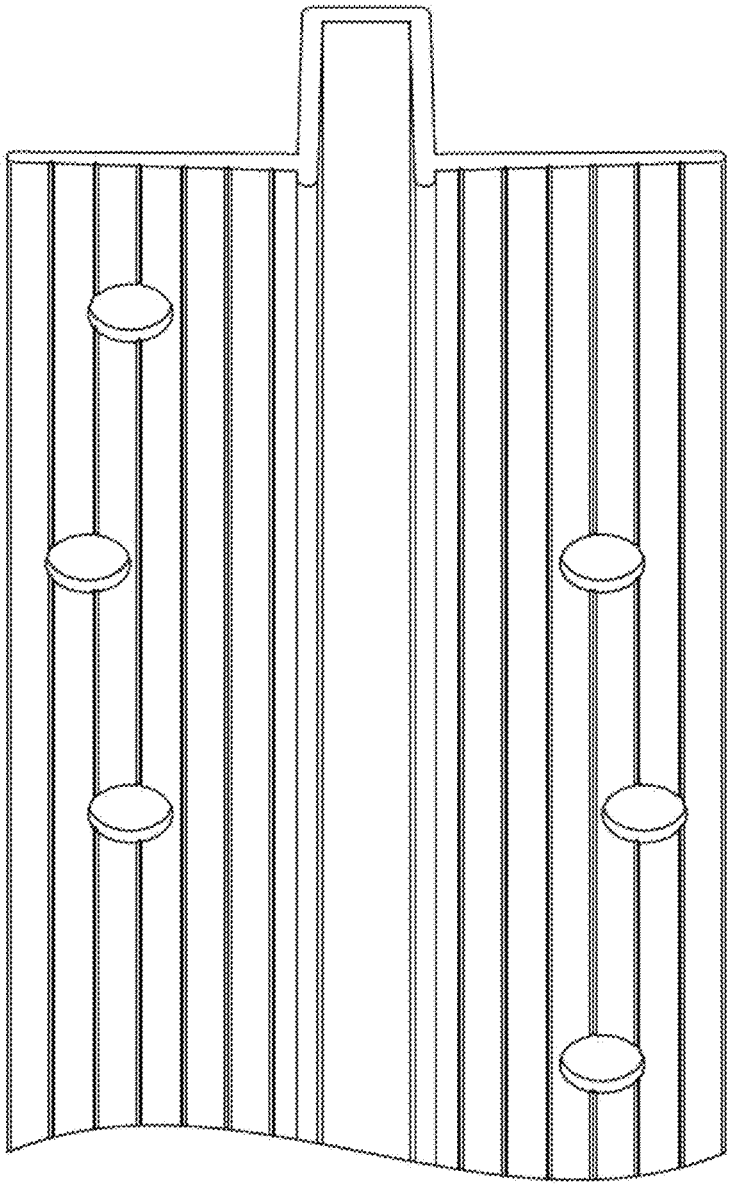
Figure 20:
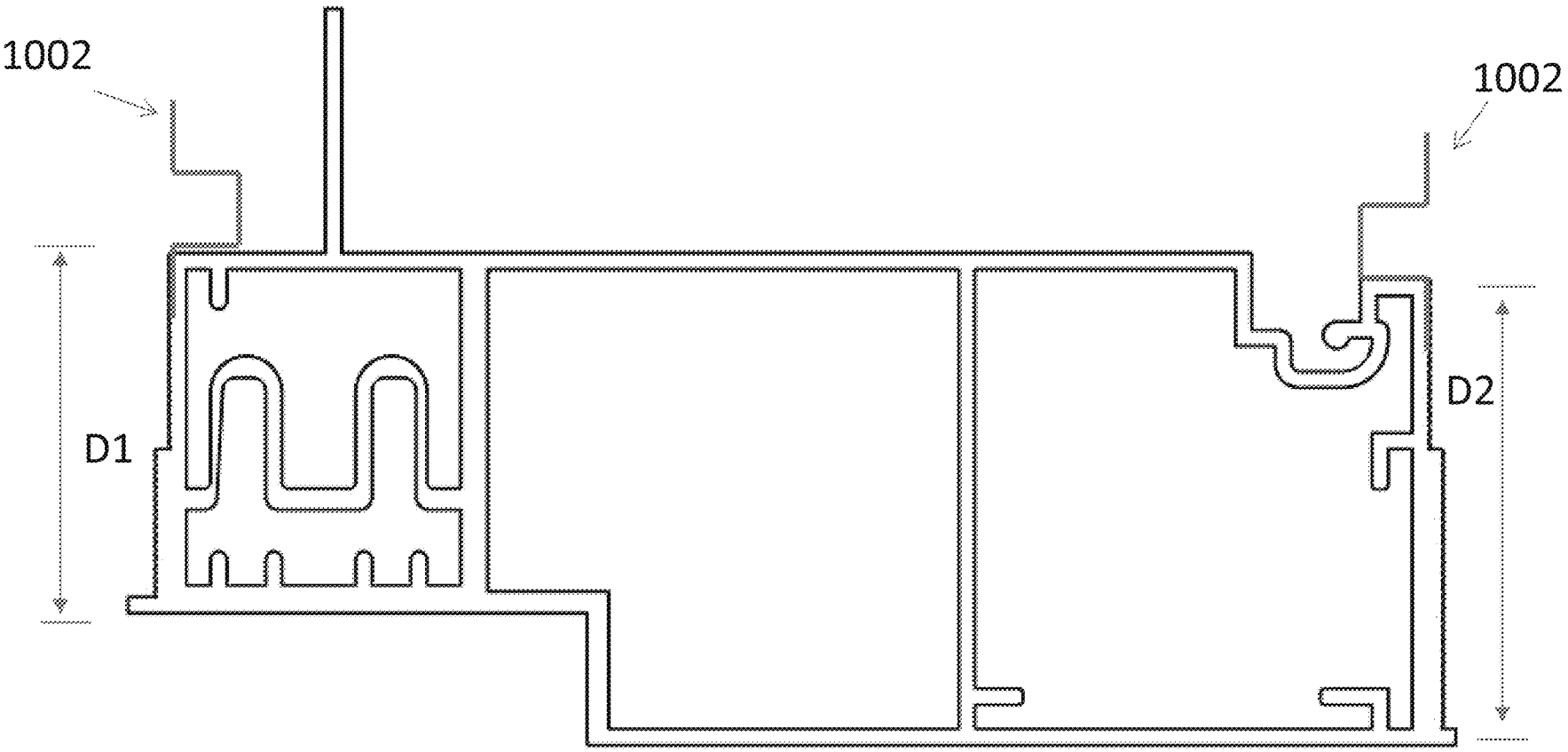
Fig. 20 Prior Art
FIG. 20 is a cross section view of a prior art door frame with a reveal.

Referring now to FIG. 18, another embodiment of an extension methodology is shown. A frame 1800 is the same as frame component 300, save that an additional jam extension recess 1802 is provided. A substantially U-shaped bracket 1804 has two front portions 1806 and a rear portion 1808, and optionally may have a rearward facing protrusion 1810. This embodiment provides an extra leg for support compared to the embodiment of FIG. 11.

Figures 12A, 12B:
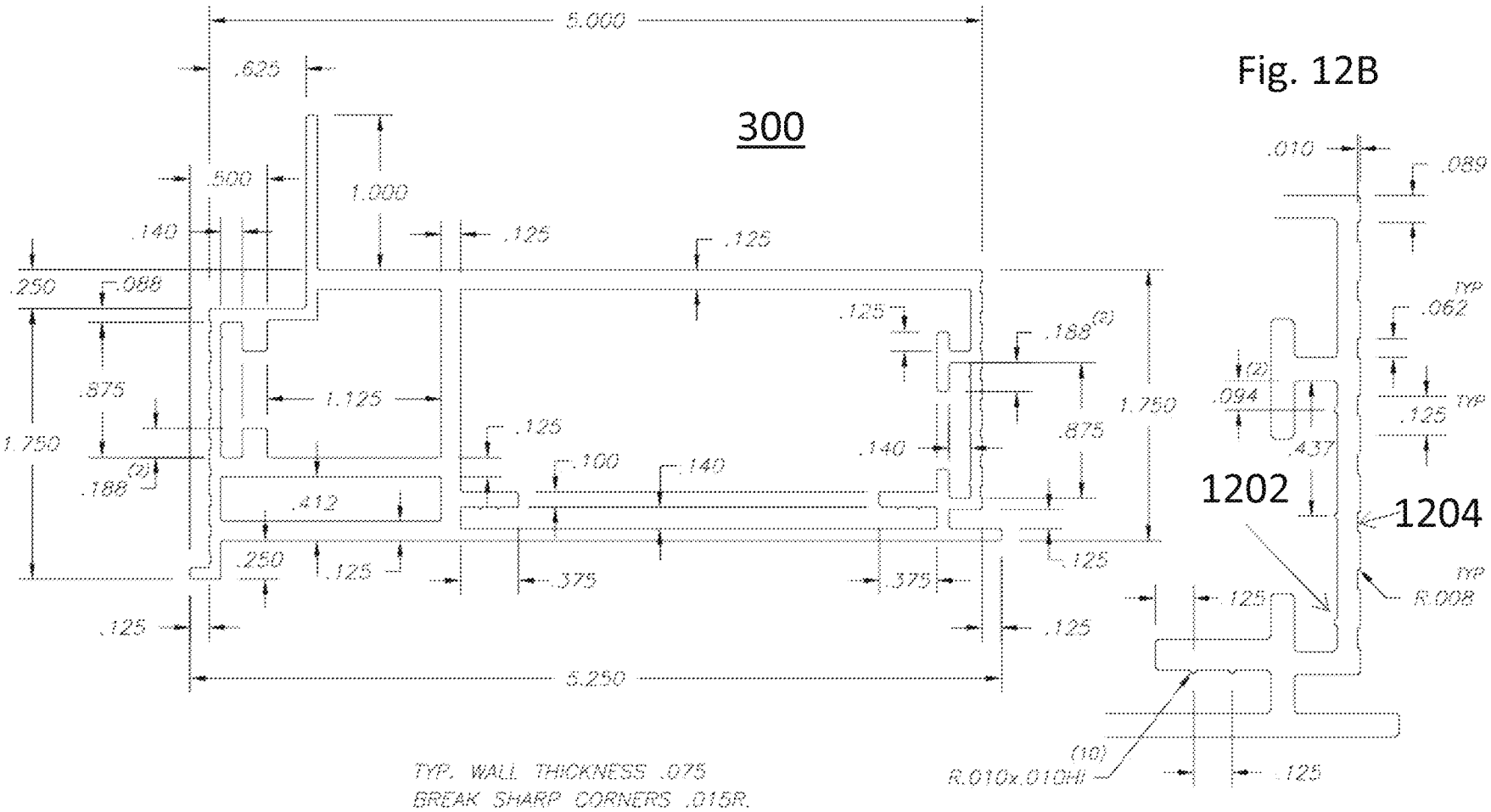
FIGS. 12A and 12B are to-scale cross sections of an embodiment of the frame component as shown in FIG. 3 with corresponding dimensions.
Figure 13:
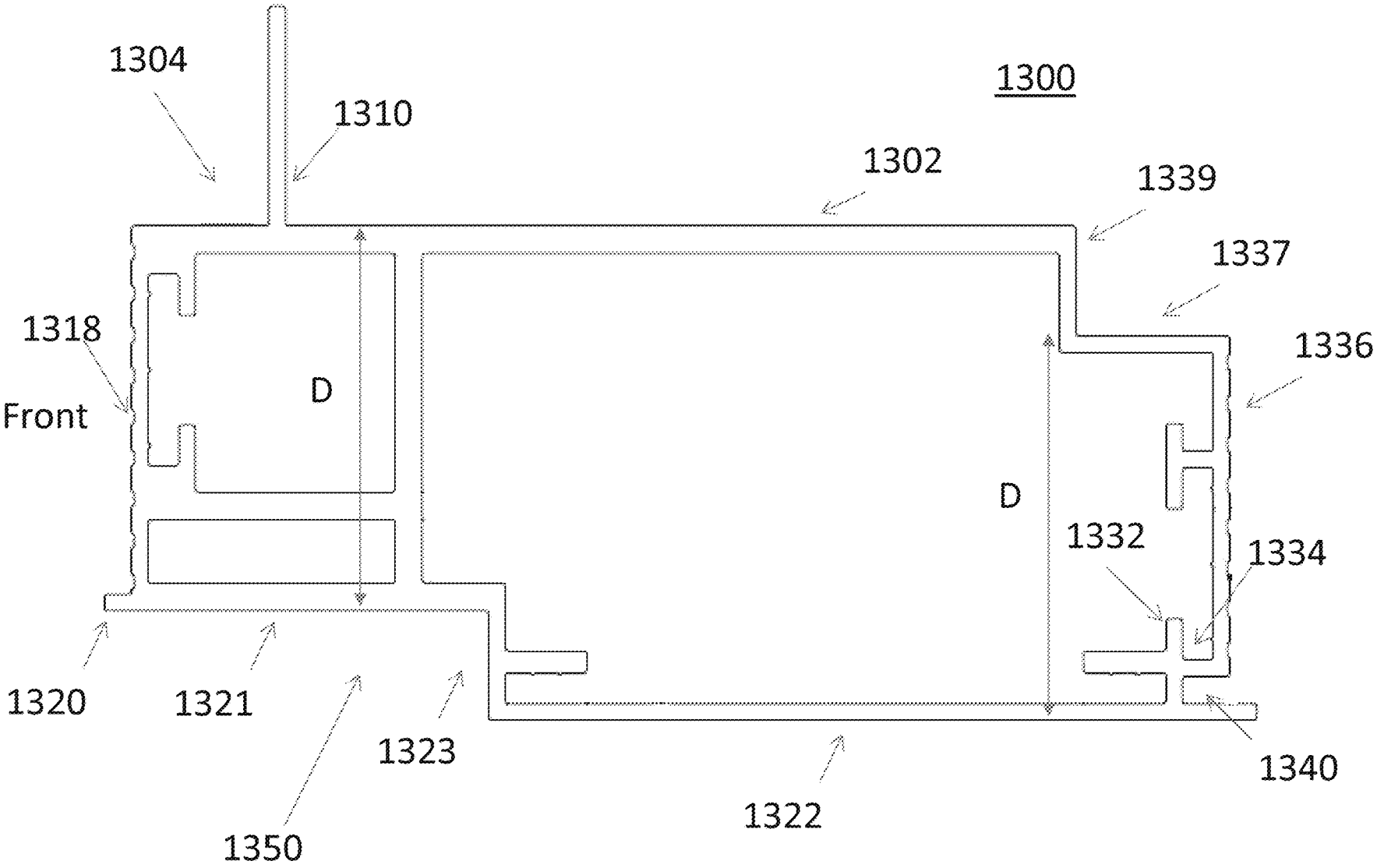
FIG. 13 is a cross section of a frame component for an outwardly opening door according to an embodiment of the invention.

Referring now to FIGS. 12A and 12B, an embodiment of frame component 300 is shown to scale and with preferred dimensions. A characteristic of these dimensions is that for a frame component made from extruded aluminum, when cut per the embodiment of FIG. 9 into sections 300A and 300B, the front section 300A will have sufficient structural integrity to support door 324 on its own without support from the rear section 300B.

As seen in FIGS. 12A and 12B, the internal portions of frame component that define the various receiving sections (e.g., corner key slots 354 and extension grip sections 361) may include projections 1202, which facilitate gripping the corner keys 110 and extension plate 902 when inserted. Walls 318 and 336 may also have a surface with grooves 1204 to better facilitate adhesion of drywall compound.

Figure 14:
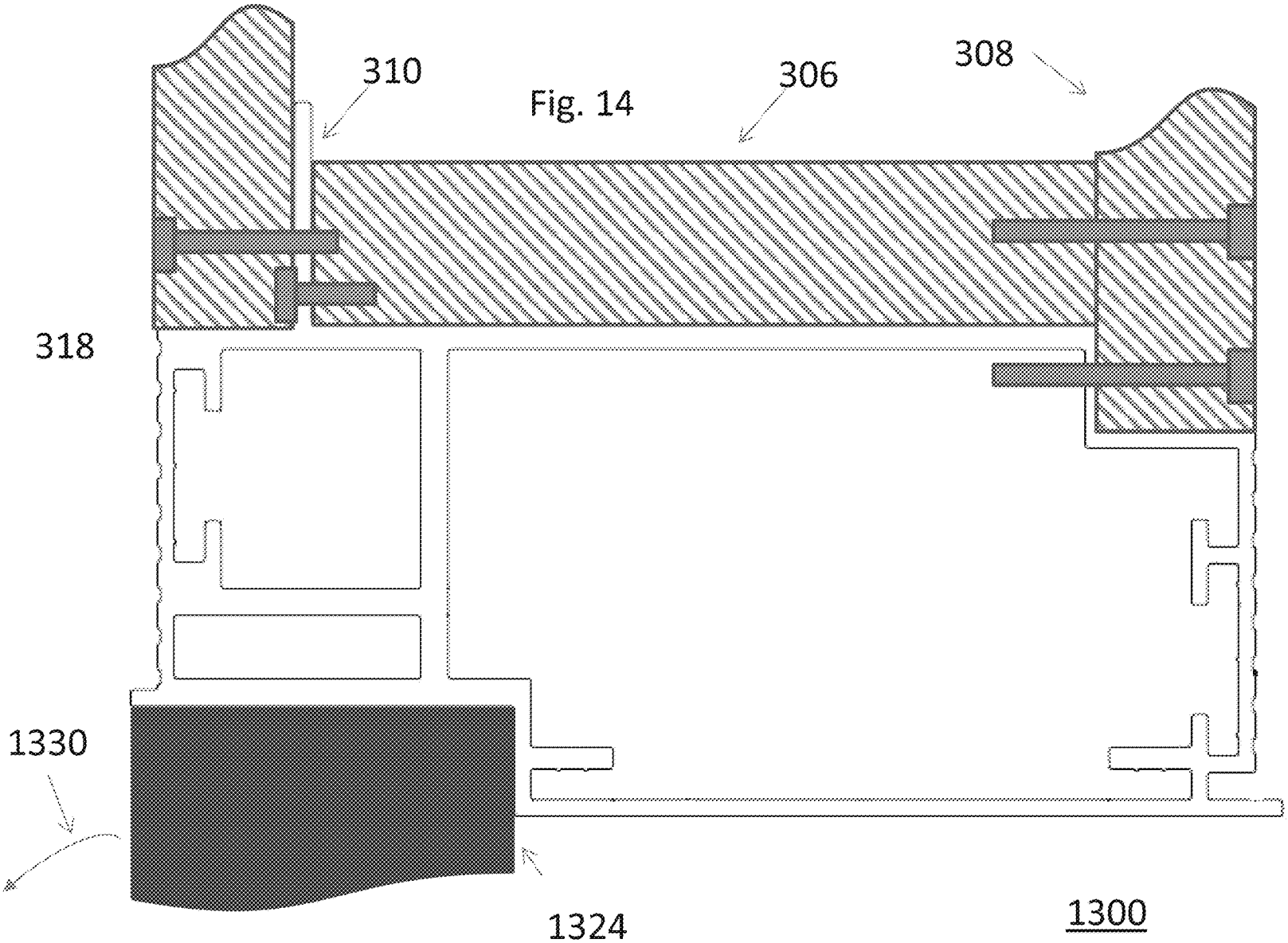
FIG. 14 is a cross section of the frame component of FIG. 13 partially mounted in a wall frame.

Referring now to FIGS. 13, 14, 17A and 17B, an embodiment of a door frame 1300 for an outwardly opening door is shown. An outwardly facing wall 1302 extends from an intermediate point of frame 1300 and terminates at a forward facing wall 1318. An outwardly extending flange 1310 extends from wall 1302. The outer surface of wall 1302 and the rear surface of outwardly extending flange 1310 will mate with wall stud 306 and an adjacent piece of mounted rear drywall 308. Outwardly extending flange 1310 is preferably longer than the thickness (width) of stud 306, but this need not be the case. FIG. 14 shows stud 306 nestling against wall 1302 and flange 1310, although in practice wood is rarely cut to perfect size and intervening shims (not shown, and to be considered part of the wall stud 306) may be inserted to create a level fit.

Forward facing wall 1318 terminates in a forward extending flange 1320. An inner side wall 1321 extends from the rear side of forward facing wall 1318 and transitions to a forward facing wall 1323 to define a door receiving area 1350 that receives a door 1324. Wall 1323 acts as door stop against inward movement of the door, such that the front of door 1324 is flush with the forward most portion of flange 1320 and the door rotates outwardly as shown by 1330 on the latch side. Inner side wall 1322 extends from wall 1323 to the rear of the frame component. A flange 1332 extends from side wall 1322, and flange 1334 extends from flange 1332 to a rear wall 1336 to define a jam extension recess 1340. Rear wall 1336 terminates at side wall 1337. Wall 1339 bridges walls 1302 and 1336. The distance D between side walls 1302 and 1321 is preferably substantially the same as the distance between walls 1322 and 1337.

FIG. 14 shows how frame 1330 may be mounted, which is similar to how frame component 300 is mounted. Tape and drywall compound are applied to finish off the walls. Frame 1300 has key slots and extension gripping section as with frame component. It can be extended in the same manner as frame component 300 with the use of plate 902, or other extension methodologies discussed herein.

Figures 15A, 15B:
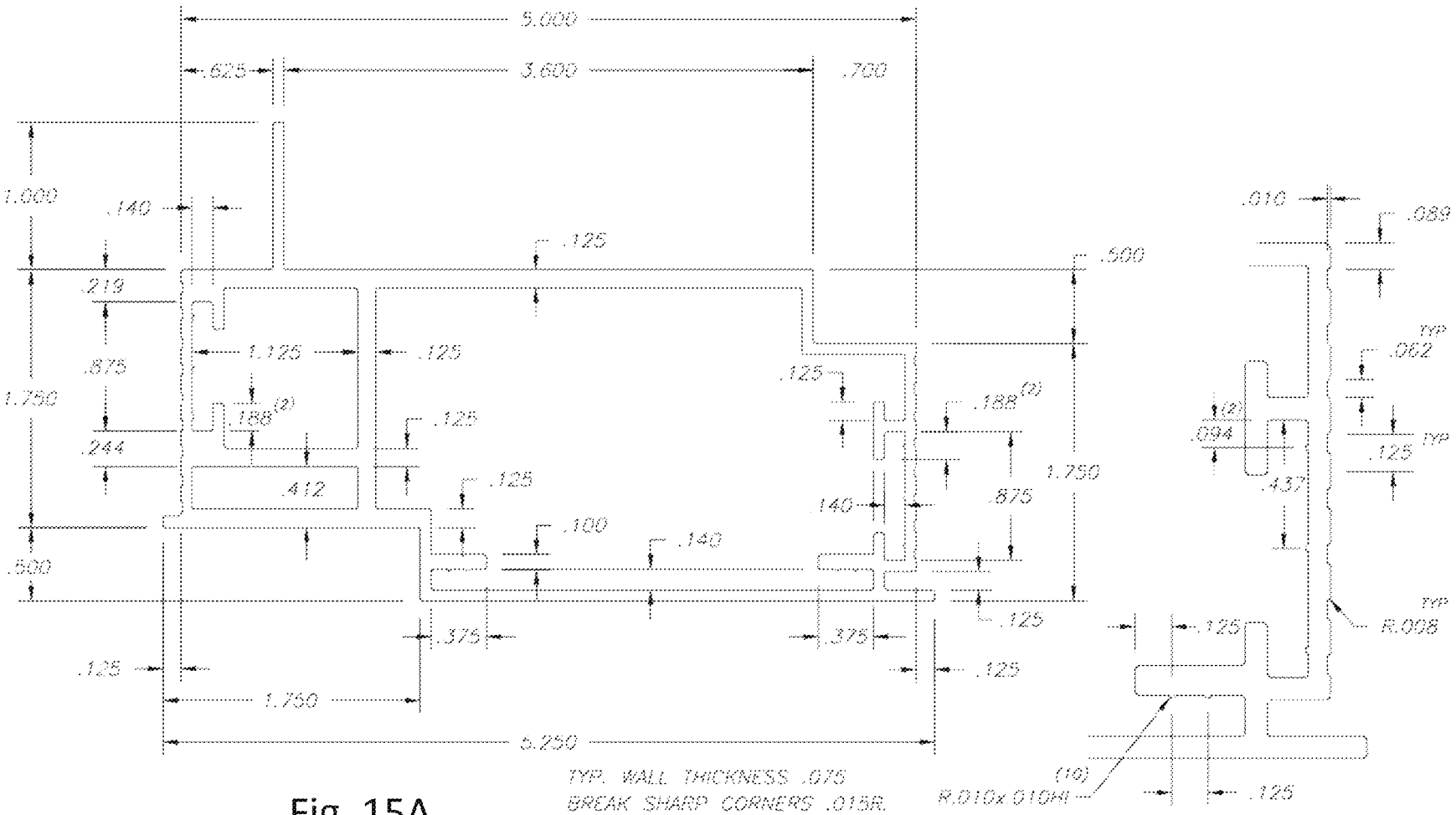
FIGS. 15A and 15B are to-scale cross sections of an embodiment of the frame component as shown in FIG. 13 with corresponding dimensions.

Referring now to FIGS. 15A and 15B, an embodiment of frame 1300 is shown to scale and with preferred dimensions. A characteristic of these dimensions is that for a frame 1300 made from extruded aluminum, when cut akin to the embodiment of FIG. 9 into forward and rear sections, the front section will have sufficient structural integrity to support door 1324 on its own without support from the rear section.

Referring now to FIGS. 16B and 21-23, another embodiment of the invention is shown, which provides an attachment methodology with one or more insertion clips to attach the rear part of the frame to the stud as an alternative or additional to diagonal insertion of screw 364. Frame component 300 may have at least one slot 2102 punched therein in the height direction. When fully installed, the number of frame slots 2102 on each of frame sections 104 and 108 may be the same as the number of hinges on which the door is mounted, but the invention is not so limited and different numbers of slots may be used. The number of slots on each of frame sections 104 and 106 may be the same or different.

Figure 22:
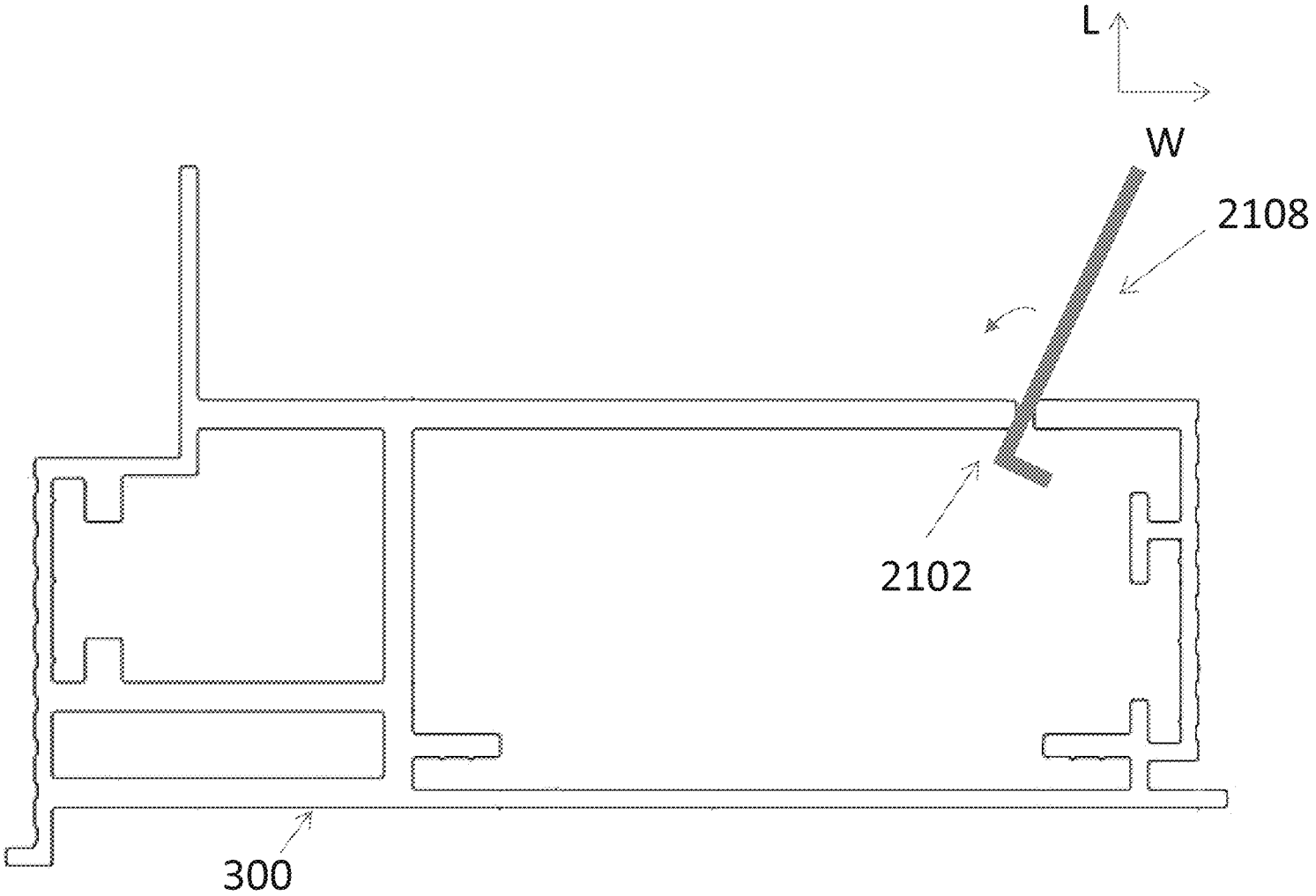
Figure 23:
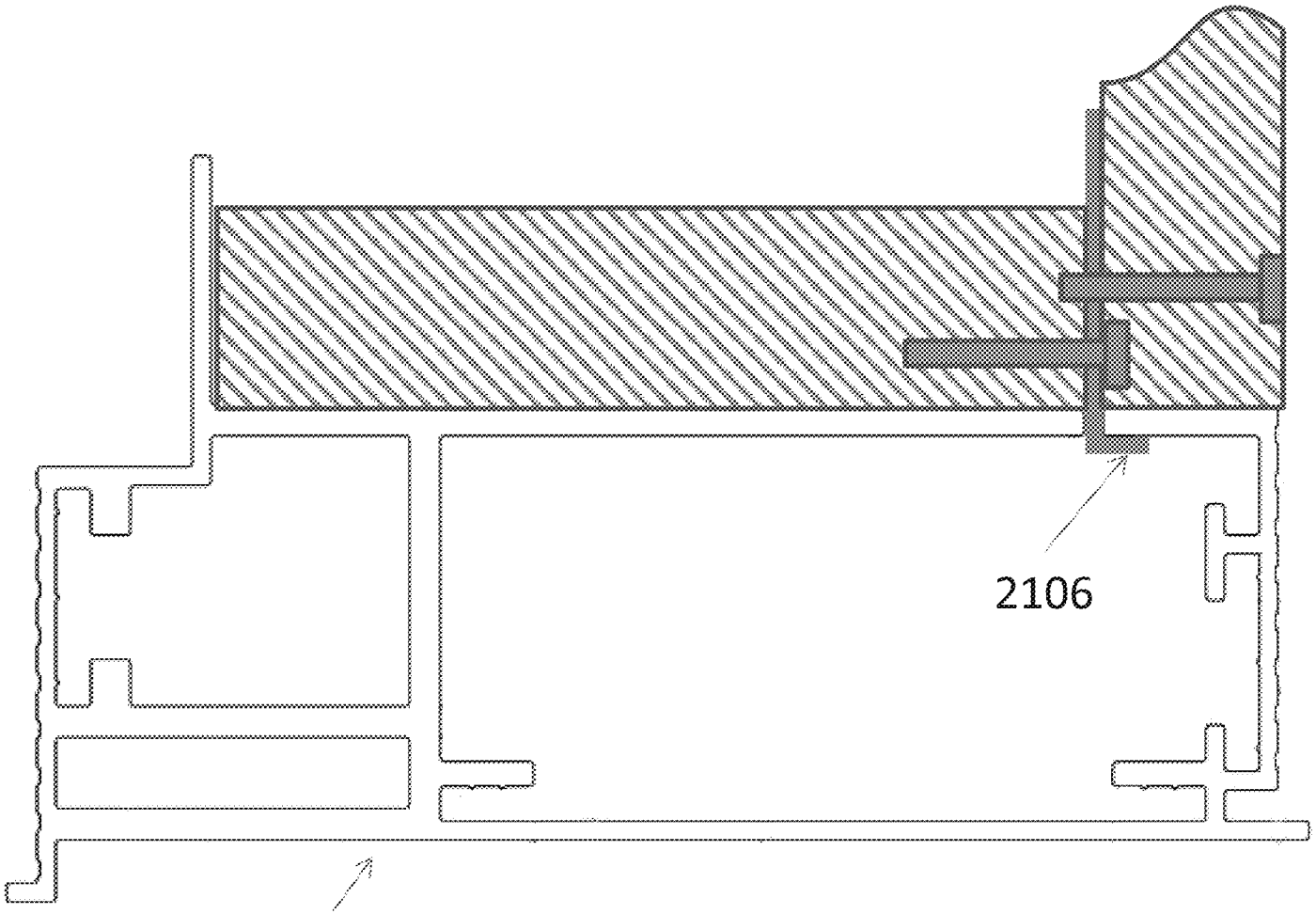

A lower section 2106 of an L shaped bracket 2104 that serves as an insertion clip is inserted into slot 2102 as shown in FIG. 22 and rotated until the lower section 2106 abuts the inner surface of outwardly facing wall 302 as shown in FIG. 23. Upper section 2108 preferably has a greater height than lower section 2106 to create lateral wings which engage the outer surface of frame 300 to prevent bracket 2104 from slipping inside. Screws 1902 mount to the studs and drywall as in FIG. 23. This same methodology may be used with other frame components.

Slot 2102 may be of any height, may be on the order of 1-2 inches, and particular 1½ inches. Slot 2102 may be of any width large enough to receive the lower section 2106 of an L shaped bracket 2104 yet small enough for lower section 2106 to engage.

Figure 21:
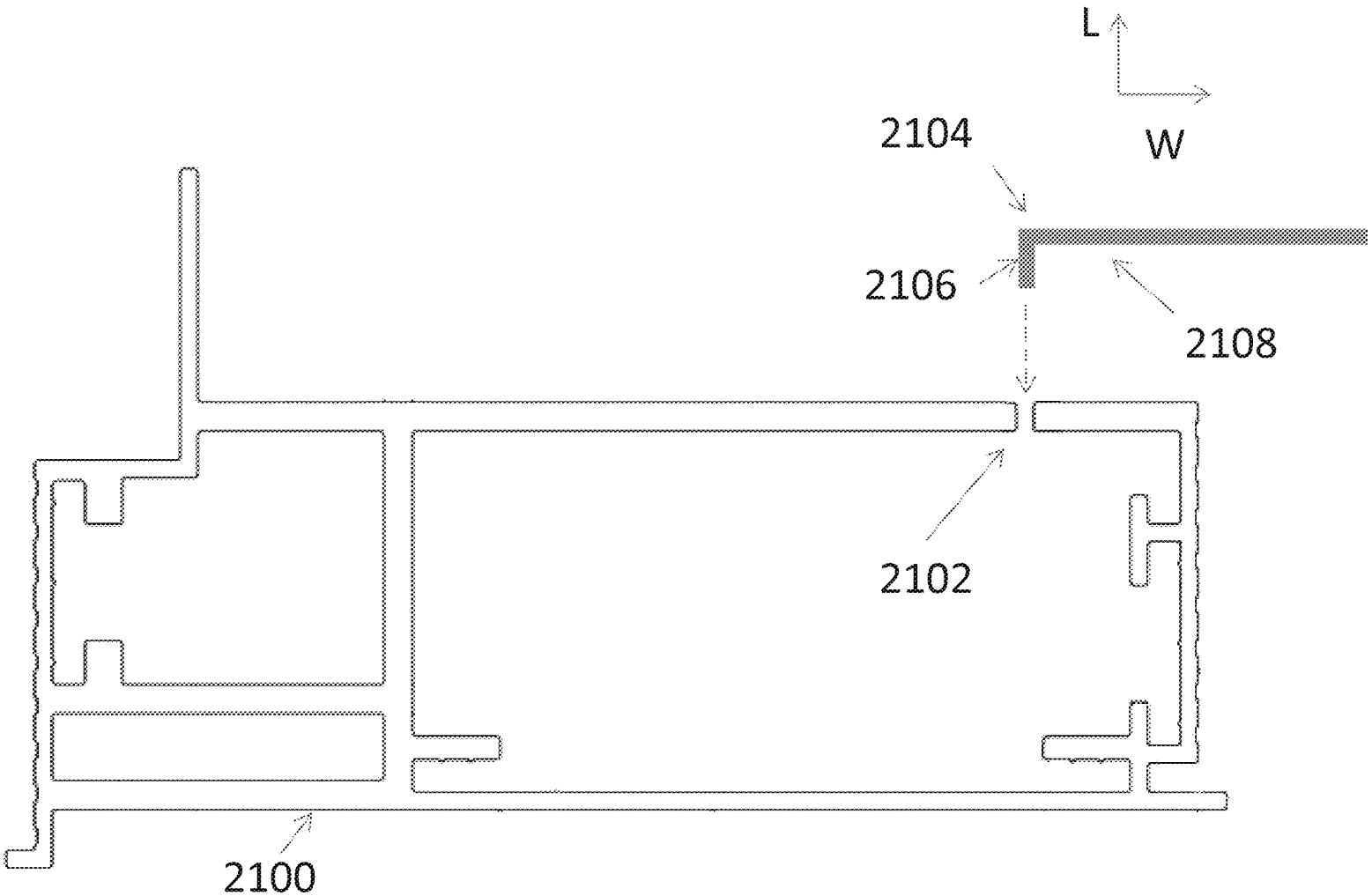
FIGS. 21-23 show an alternative installation method for the frame component of FIG. 3.
Figure 24:
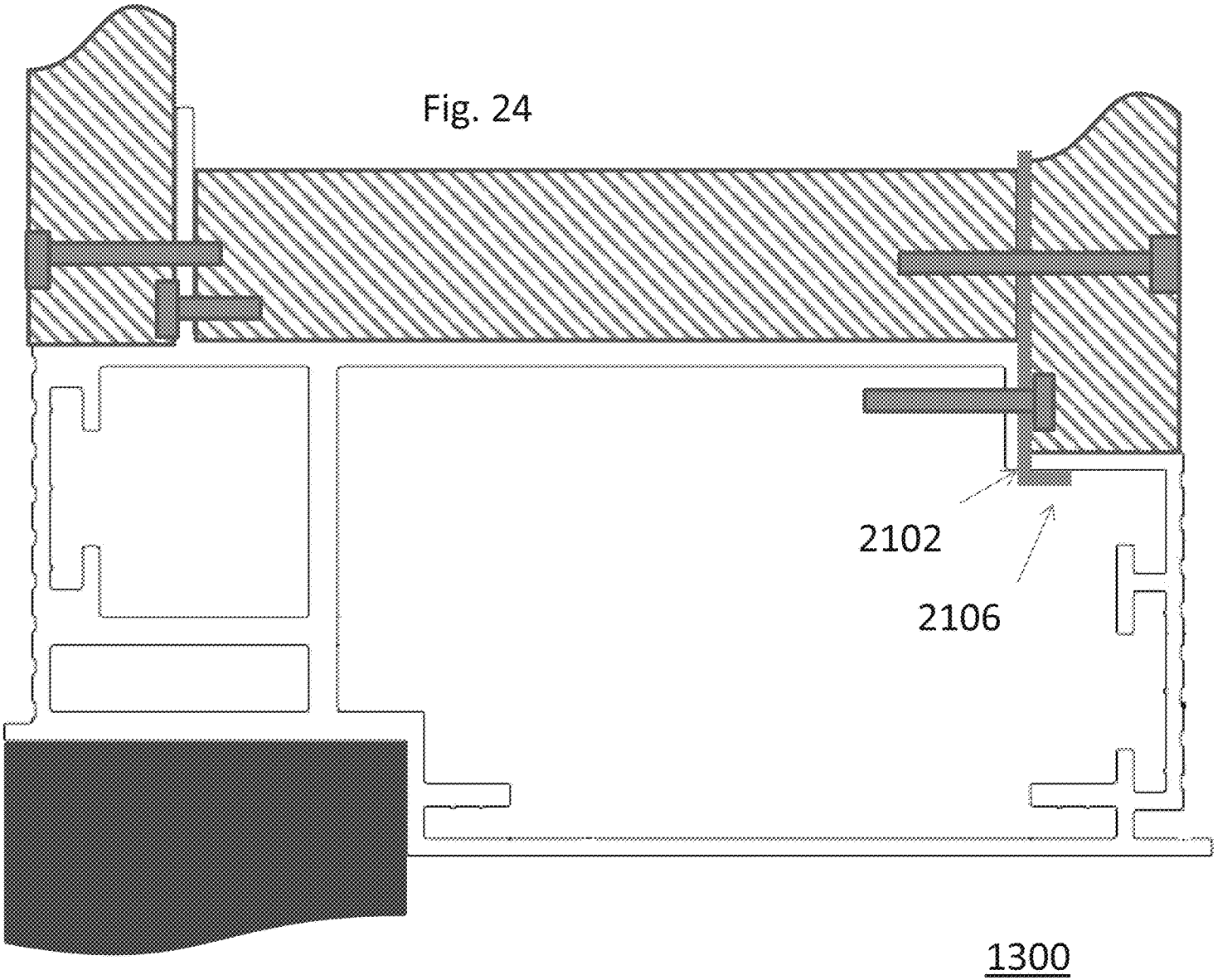
FIG. 24 shows an alternative installation method for the frame component of FIG. 14.

Referring now to FIG. 24, the frame 1330 of FIG. 14 may be mounted in a similar methodology to FIGS. 21-23, and specifically include a slot 2102 and bracket 2104. The number and placement of slots 2102 and brackets 2104, as well as the installation methodology, may be the same as described with respect to FIGS. 21-23.

Figure 25:
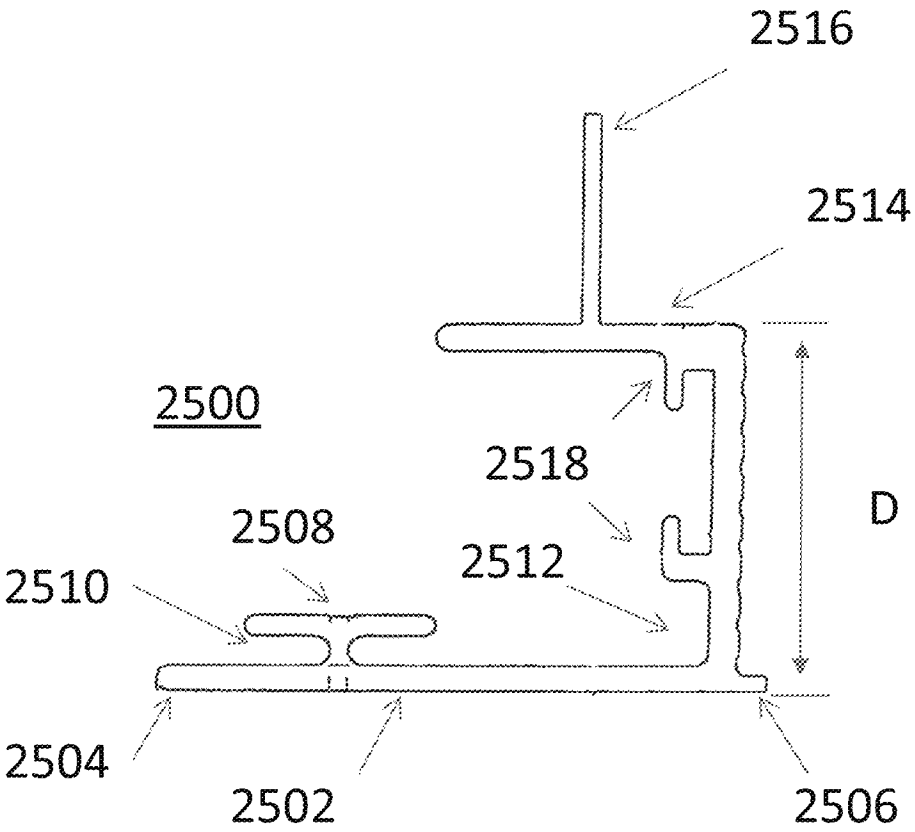
FIGS. 25-27 show an alternative jam extension and installation method for a frame component such as shown in FIG. 3 or 14.

Referring now to FIG. 25 another embodiment of a jam extension 2500 is shown. Jam extension 2500 includes an inner side wall 2502 with a forward extending end 2504 and a rear extending end 2506. A T-shaped section 2508 intends inwardly to define an expansion grip region 2510. A rear wall 2512 extends from the inner side wall 2502 to an outer side wall 2514. An outwardly extending wall 2516 extends from outer side wall 2514. Inwardly facing flanges 2418 define a corner key slot for attachment with a corner key as discussed herein. The distance D between side walls 2502 and 2414 may be substantially the same as the distance of the corresponding surfaces in frame components 300 or 1300 as discussed above so as to maintain an even visual appearance on the front and rear sides.

To facilitate component connection, the expansion grip region 2510 may have the same protrusion internally as discussed with respect expansion grip region sections 361. Rear wall 2512 may have the same profile characteristics as described with respect to wall 336 to facilitate the later application of drywall compound.

Figure 26:
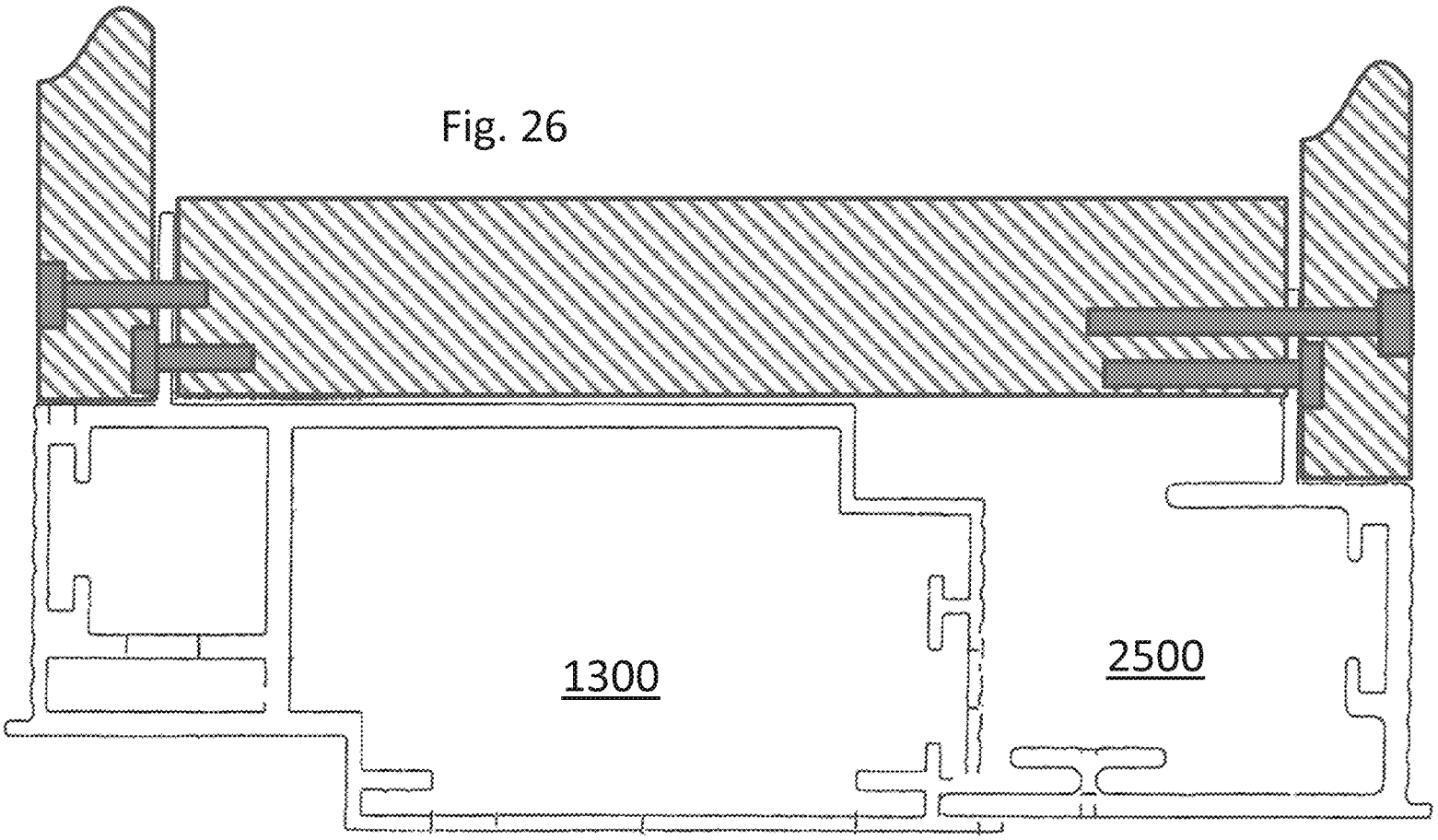

Jam extension 2500 can be used for several different extension methodologies. One methodology as shown in FIG. 26 inserts the forward extending end 2504 into jam extension recess 1340 of frame component 1300. This configuration is useful for standard size wall studs that are longer than frame component 1300 (e.g., a 6" wall stud), and may be sized so as to combine with frame 1300 (or 300) to meet a 6" wall stud standard.

Figure 27:
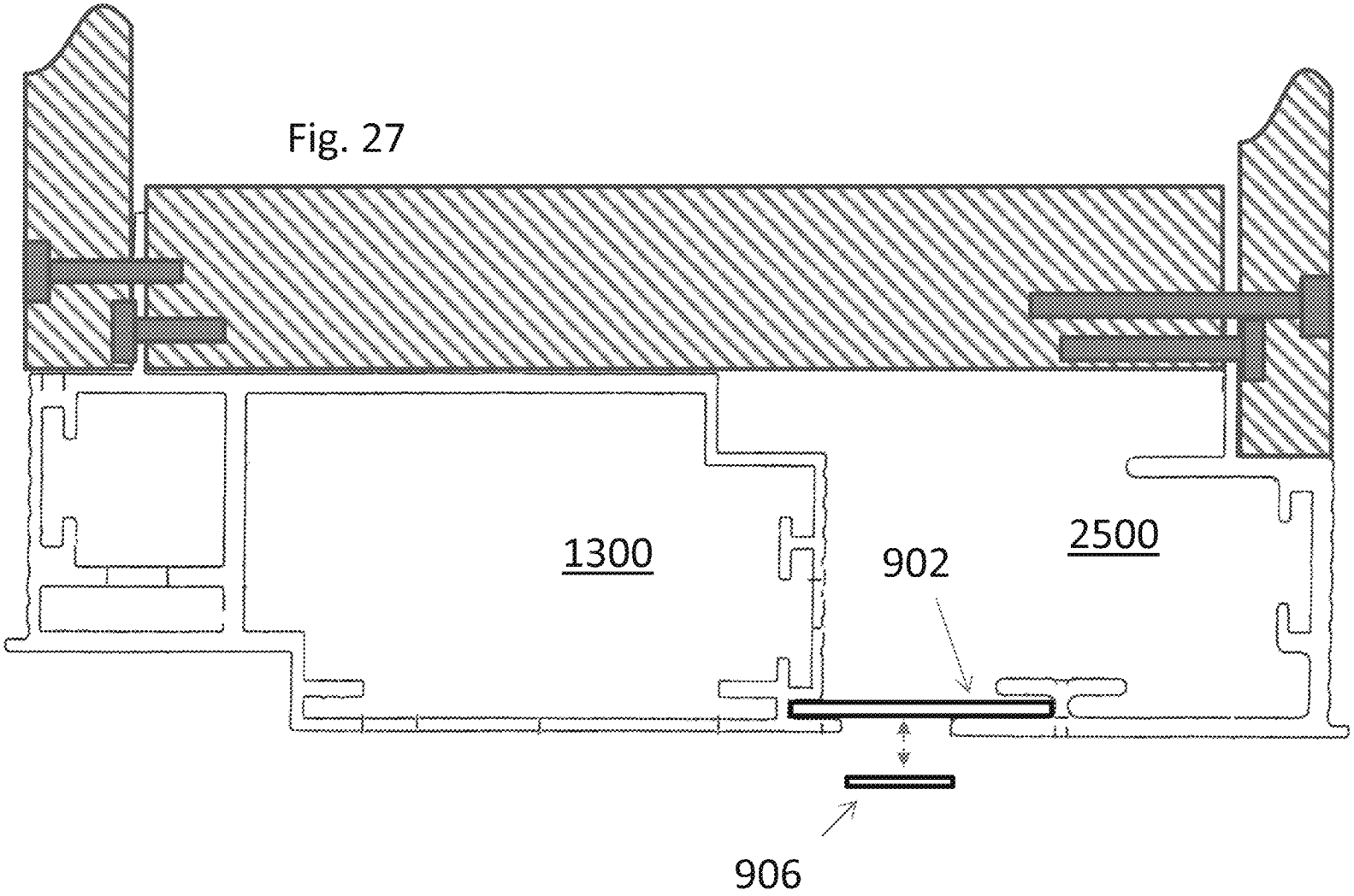

A second methodology is shown in FIG. 27, which can be used for even longer studs by bridging the two jam expansion grip sections 1340 and 2510 with plate 902 as discussed with respect to FIG. 9; plate 906 may be added to cover the recess and create smoother exterior appearance.

The same methodologies described above for use of jam extension 2500 with frame component 1300 can be used with frame component 300, or similar frame components.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. A door frame component for defining a side of a door frame, comprising:

a front wall, a rear wall, an outer wall and an inner wall;

a length of the front wall being substantially the same as a distance between the inner wall and the outer wall;

an internal cavity at least partially defined by space between the inner wall and outer wall;

opposing first and second gripping sections defined in the internal cavity at least partially by first and second internal flanges in the internal cavity;

wherein the frame has sufficient structural integrity such that when the frame is cut height wise between the first and second internal flanges into front and rear sections, the front section can support a door on its own without the rear section;

wherein the opposing first and second gripping sections have an uneven surface to facilitate gripping of a plate.

2. The door frame of claim 1, further comprising the plate, wherein when the frame is cut height wise between the first and second internal flanges into front and rear sections, the plate is adapted to snuggly fit into the first and second gripping sections to thereby extend a width of the door frame component.

3. The door frame of claim 1, wherein the inner wall extends further rearward than the outer wall.

4. The door frame of claim 1, further comprising a recess between the rear wall and the inner wall, the recess extending into the inner cavity.

5. The door frame component of claim 4, further comprising a bracket have a first section adapted to mount within the recess, and a second section that extends in parallel with the rear wall when the bracket is mounted in the recess to thereby extend a width of the door frame component.

6. The door frame of claim 1, wherein the opposing first and second gripping sections are defined in the internal cavity at least partially by the inner wall.

7. The door frame of claim 1, further comprising:

a closed slot in the outer wall;

a substantially L-shaped bracket adapted to insert into the slot and rotate in the slot to a mounting orientation in which a first portion of the bracket flush against an inner side of the outer wall and a second portion of the bracket is parallel to the front wall.

8. The door frame component of claim 1, further comprising a front corner separating the front wall and the outer wall, the front corner at least partially defining a front drywall receiving area.

9. The door frame of claim 1, wherein a rear side of the front wall and the inner wall define an inwardly opening door receiving area, and the rear side of the front wall defines as stop of an inwardly opening door.

10. The door frame of claim 1, further comprising a front corner separating the front wall and the inner wall, the front corner at least partially defining an outwardly opening door receiving area.

11. The door frame of component of claim 1, further comprising:

the outer wall is a first outer wall;

the frame component includes a second outer wall;

a rear facing wall separates the first and second outer walls;

wherein the rear facing wall and the first outer wall at least partially define a rear drywall receiving area.

12. The door frame component of claim 1, further comprising a first recess between the rear wall and the inner wall, and a second recess between the rear wall and the outer wall.

13. The door frame component of claim 12, further comprising a bracket have a first section adapted to mount within the first recess, a second section adapted to mount with the second recess, and a third section that extends in parallel with the rear wall when the bracket is mounted in the first and second recess to thereby extend a width of the door frame component.

14. The door frame of component of claim 1, further comprising:

the outwardly facing wall is a first outer wall;

the frame component includes a second outer wall;

a rear facing wall separates the first and second outer walls;

wherein the rear wall and the first outer wall at least partially define a rear drywall receiving area.

* * * * *